US006786018B2

(12) United States Patent
Webb et al.

(10) Patent No.: US 6,786,018 B2
(45) **Date of Patent: *Sep. 7, 2004**

(54) COPING OR FASCIA ASSEMBLY FOR BUILDING ROOF

(75) Inventors: William C. Webb, Fletcher, NC (US); Neil Tedder, Asheville, NC (US); Christopher K. McCoy, Candler, NC (US); David McKinney, Weaverville, NC (US)

(73) Assignee: W. P. Hickman Company, Asheville, NC (US)

( * ) Notice: Subject to any disclaimer, the term of this patent is extended or adjusted under 35 U.S.C. 154(b) by 67 days.

This patent is subject to a terminal disclaimer.

(21) Appl. No.: 10/027,231

(22) Filed: Dec. 26, 2001

(65) Prior Publication Data

US 2002/0083666 A1 Jul. 4, 2002

Related U.S. Application Data

(63) Continuation-in-part of application No. 09/598,003, filed on Jun. 20, 2000, now Pat. No. 6,360,504, which is a continuation-in-part of application No. 09/544,409, filed on Apr. 6, 2000, now Pat. No. 6,212,829.

(51) Int. Cl.[7] ..... E04F 19/02
(52) U.S. Cl. ..... 52/300; 52/96; 52/60
(58) Field of Search ..... 52/300, 96, 94, 52/58, 60

(56) References Cited

U.S. PATENT DOCUMENTS

| | | | | |
|---|---|---|---|---|
| 1,337,840 A | 4/1920 | Hawley | | |
| 1,740,753 A | 12/1929 | Vallas | | |
| 1,782,246 A | 11/1930 | Schneider | | |
| 2,123,967 A | 7/1938 | Richter | 108/26 | |
| 2,554,779 A | 5/1951 | Goodwin | 72/86 | |
| 2,734,602 A | 2/1956 | Dawson | 189/75 | |
| 2,855,776 A | 10/1958 | Trostle | 72/86 | |
| 3,012,376 A | 12/1961 | Reddy et al. | 50/66 | |
| 3,024,573 A | 3/1962 | McKinley | 50/66 | |
| 3,187,464 A | 6/1965 | Sharp | 50/66 | |
| 3,237,352 A | 3/1966 | Edwards | 52/60 | |
| 3,404,495 A | 10/1968 | Simpson, Jr. | 52/58 | |

(List continued on next page.)

OTHER PUBLICATIONS

MM Systems, Inc. "Snap–lok Coping" (1 page) 1984.
Hickman Permasnap® Coping (1 page) circa. 1974.
Extruded Aluminum Gravel Stops and Copings (2 pages) date unknown.
Construction Specialties "C/S Colortrim Coping" (2 pages) date unknown.
Trion "Architectural Copings" (1 page) date unkown.
Metal–Era Inc. "Full Coping" (1 page) 1981.
Overly Manufacturing Company "Overly Metal Coping" (4 pages) 1965.

*Primary Examiner*—Robert Canfield
(74) *Attorney, Agent, or Firm*—Kennedy Covington Lobdell & Hickman, LLP

(57) ABSTRACT

A coping or fascia assembly for a flat or raised building roof edge, parapet wall, cant dam, gravel stop or the like resiliently maintains the coping or fascia assembly in a tight-fitting interlocking installation and has a locator member beneath the coping or fascia cap for maintaining at least a portion of the outer coping cap in a predetermined cross-sectional shape and in an accurate alignment between adjacent sections of the coping cap. The locator member has a free-floating side edge in order to allow it to yield during installation of the coping or fascia cap. The preferred triangular locator member is generally symmetrical with respect to a line normal to the face of the wall, dam stop or other raised roof protrusion. The coping assembly is quicker, easier, and less costly to install than prior such structures and provides enhanced protection for interior or underlying components or structures.

25 Claims, 22 Drawing Sheets

U.S. PATENT DOCUMENTS

| | | | | |
|---|---|---|---|---|
| 3,405,485 | A | 10/1968 | Edwards | 52/69 |
| 3,447,273 | A | 6/1969 | Thom | 52/58 |
| 3,503,162 | A | 3/1970 | Ward | 52/60 |
| 3,634,984 | A | 1/1972 | Murphy | 52/101 |
| 3,668,811 | A | 6/1972 | Pollard | 52/94 |
| 3,719,010 | A | 3/1973 | Hickman | 52/60 |
| 3,802,140 | A | 4/1974 | Hickman | 52/300 |
| 3,862,531 | A | 1/1975 | Attaway et al. | 52/300 |
| RE28,870 | E | 6/1976 | Attaway et al. | 52/300 |
| 4,009,548 | A | 3/1977 | Hicks | 52/469 |
| 4,071,987 | A | 2/1978 | Hickman | 52/94 |
| 4,083,158 | A | 4/1978 | Wolma | 52/300 |
| 4,155,203 | A | 5/1979 | Wolma | 52/60 |
| 4,155,206 | A | 5/1979 | Player | 52/200 |
| 4,404,777 | A | 9/1983 | Lolley et al. | 52/60 |
| 4,419,850 | A | 12/1983 | Butzen | 52/60 |
| 4,439,956 | A | 4/1984 | House | 52/60 |
| 4,472,913 | A | 9/1984 | Hickman | 52/96 |
| 4,483,112 | A | 11/1984 | Rueblinger | 52/94 |
| 4,488,384 | A | 12/1984 | Hickman | 52/60 |
| 4,549,376 | A | 10/1985 | Hickman | 52/94 |
| 4,550,535 | A | 11/1985 | Drogosch | 52/60 |
| 4,586,301 | A | 5/1986 | Hickman | 52/96 |
| 4,592,176 | A | 6/1986 | van Herpen | 52/96 |
| 4,598,507 | A | 7/1986 | Hickman | 52/94 |
| 4,641,476 | A | 2/1987 | Webb et al. | 52/60 |
| 4,662,129 | A | 5/1987 | Hickman | 52/96 |
| 4,780,997 | A | 11/1988 | Taylor et al. | 52/96 |
| 4,780,999 | A | 11/1988 | Webb et al. | 52/96 |
| 4,858,406 | A | 8/1989 | Lane et al. | 52/300 |
| 4,890,426 | A | 1/1990 | Hickman et al. | 52/58 |
| 4,909,006 | A | 3/1990 | Hickman et al. | 52/288 |
| 4,964,248 | A | 10/1990 | Braine et al. | 52/60 |
| 4,969,250 | A | 11/1990 | Hickman et al. | 29/521 |
| 4,970,832 | A | 11/1990 | van Herpen | 52/60 |
| 5,845,435 | A | 12/1998 | Knudson | 52/11 |
| 5,893,247 | A | 4/1999 | Hickman et al. | 52/300 |
| 5,927,023 | A * | 7/1999 | Kittilstad | 52/60 |
| 6,212,829 | B1 | 4/2001 | Webb et al. | 52/96 |
| 6,216,408 | B1 * | 4/2001 | Davidson | 52/300 |
| 6,360,504 | B1 * | 3/2002 | Webb et al. | 52/300 |
| 2001/0027625 | A1 * | 10/2001 | Webb et al. | 52/96 |

OTHER PUBLICATIONS

Hickman "Permasnap Coping Controls Water With Unique Cutter/Chair" (1 page) 1982.

Hickman "Formed Products" (1 page) 1986.

MM Systems Catalog pages (4 pages) 1997.

Hickman, "The Slimline Fascia/Cap That's An Engineered Parapet Wall" (1 page) 1980.

Dec. 2, 1993 Data Sheet for Double Tapered Catalog, Metal–Era Manufacturer's Catalog, published in USA.

MM Systems, Inc. "Architectural Roof–Edge Technologies" (4 pages) date unknown.

Metal–Era, Inc. Anchor–Tite® Fascia for Roofblok™ Ballast System Version (3 pages) date unknown.

Architectural Products Co. "Formed Aluminum Gravel Stops and Copings" (1 page) date unknown.

* cited by examiner

COPING OR FASCIA ASSEMBLY FOR BUILDING ROOF

This application is a continuation-in-part of a previously-filed application, Ser. No. 09/598,003, filed Jun. 20, 2000, now U.S. Pat. No. 6,360,504 which was a continuation-in-part of Ser. No. 09/544,409, filed Apr. 6, 2000, issued as U.S. Pat. No. 6,212,829 on Apr. 10, 2001, which are owned by the same assignee as the current application and are hereby incorporated by reference.

BACKGROUND AND SUMMARY OF THE INVENTION

The present invention relates generally to fascia, coping, cover or cap assemblies for covering a parapet wall, cant dam, gravel stop, or other raised upward protrusion extending along the edge or other area of a building roof, as well as to flat roof edges or to free-standing or other types of walls. More specifically, the present invention relates to such coping or cover assemblies having arrangements for resiliently maintaining the coping or cover assembly in a tight-fitting installation and having a locator member for maintaining at least a portion of the outer coping or cover cap in a predetermined cross-sectional shape and accurately aligned between adjacent sections of the coping or cover cap.

Various fascia, coping, cap or cover assemblies for flat roof edges, free-standing walls, parapet walls, cant dams, gravel stops, or other such raised protrusions from a building roof have long been provided in the prior art. However, most of such prior coping or cover assemblies have suffered from the same disadvantages of being relatively time-consuming, difficult and costly to install, as well as often being unacceptably misaligned at joints between adjacent end-to-end coping or cover sections. Such misalignment is not only unattractive aesthetically, but it can also result in unacceptable amounts of wind or water being admitted to the interior of the coping or cover assembly structures, thus exposing the structures as well as the roof edges, walls, cants or stops to potential damage. In addition, many of such prior coping or cover arrangements have lacked a sufficiently tight-fitting installation such that sagging or rattling can occur.

Accordingly, the present invention seeks to overcome the above-mentioned disadvantages of the prior art fascia, coping or cover systems by providing a fascia, coping, cap or cover, and its underlying structure, that is quicker, easier, and less costly to install. In addition, the present invention provides a tight-fitting assembly with greatly improved alignment between adjacent coping or cover cap sections resulting in a smoother and more pleasing aesthetic appearance, as well as enhanced protection for interior or underlying components or structures.

A fascia, coping, cover, or roof edge assembly according to the present invention preferably includes a cover cleat for fixed securement to a flat roof edge or a raised protrusion, either free-standing or protruding from the building roof, having an upper edge or protrusion surface, an outer edge or protrusion face extending generally downwardly from one side of the upper protrusion surface and an inner edge or protrusion face extending from an opposite, inner side of the upper protrusion face. The cover cleat preferably includes an upper cleat portion extending along or adjacent to the edge or protrusion upper surface, an outer cleat portion extending downwardly at or adjacent the outer edge or protrusion face from an outer side of the upper cleat portion, and an inner cleat portion extending along or adjacent to the inner protrusion face from an opposite, inner side of the upper cleat portion. A coping or cover cap has an upper cap portion, an outer cap portion extending generally downwardly from an outer side of the upper cap portion and an inner cap portion extending from an opposite, inner side of the upper cap portion. The outer and inner cap portions are secured to the respective outer and inner cleat portions, preferably by way of generally hook-shaped cap portion edges that allow for snap-on installation onto the outer and inner cleat portions.

A spring clip may be secured to the coping or cover cleat and is disposed between the cleat and at least a portion of the coping or cover cap, with the spring clip having at least one resilient spring clip protrusion resiliently engaging a portion of the underside of the coping or cover cap for maintaining a resiliently-biased tight-fitting assembly. A coping or cover locator is also provided and is preferably secured (at least along one side edge) to the cleat between the cleat and the coping or cover cap. The locator protrudes from the cleat to engage a portion of the underside of the coping or cover cap in order to space such portion of the coping or cover cap a predetermined, generally fixed distance from the cleat. The locator also maintains at least a portion of the coping or cover cap in a predetermined cross-sectional shape. In one preferred embodiment of the invention, the locator has one side edge that is free-floating in order to allow the locator to resiliently yield and better facilitate the installation of the coping or cover cap while still performing its locating and support functions for the coping or cover cap.

Such coping or cover cleats and coping or cover caps according to the present invention are typically in longitudinally-extending sections of the predetermined length. In installations where more than one section is required, the coping or cover cap sections serially and abuttingly engage one another along the roof edge or the raised protrusion on the building roof. In such installations, the present invention provides a joint cover disposed between the underside of adjacent coping or cover cap sections and the locator at the abutting engagement of adjacent coping or cover cap sections. The joint cover is preferably of substantially the same lateral cross-sectional configuration as the coping or cover cap. Thus the locator, which is preferably of a configuration that is symmetrical with respect to a line normal to the adjacent surface of the building structure or raised roof protrusion, provides additional strength for the joint as well as working in conjunction with the joint cover to maintain the abutting ends of the adjacent coping or cover cap sections in proper alignment with one another and to minimize entrainment of wind or water.

Although the various components of the embodiments described below are preferably fabricated of sheet metal, such as galvanized steel, for example, other sheet or even molded materials can also be used. Also, the tab-locking arrangements discussed below are generally interchangeable with driven or threaded fasteners or various welding attachments.

Additional objects, advantages, and features of the present invention will become apparent from the following description and the appended claims, taken in conjunction with the accompanying drawings.

DETAILED DESCRIPTION OF THE PREFERRED EMBODIMENTS

Figure 1:
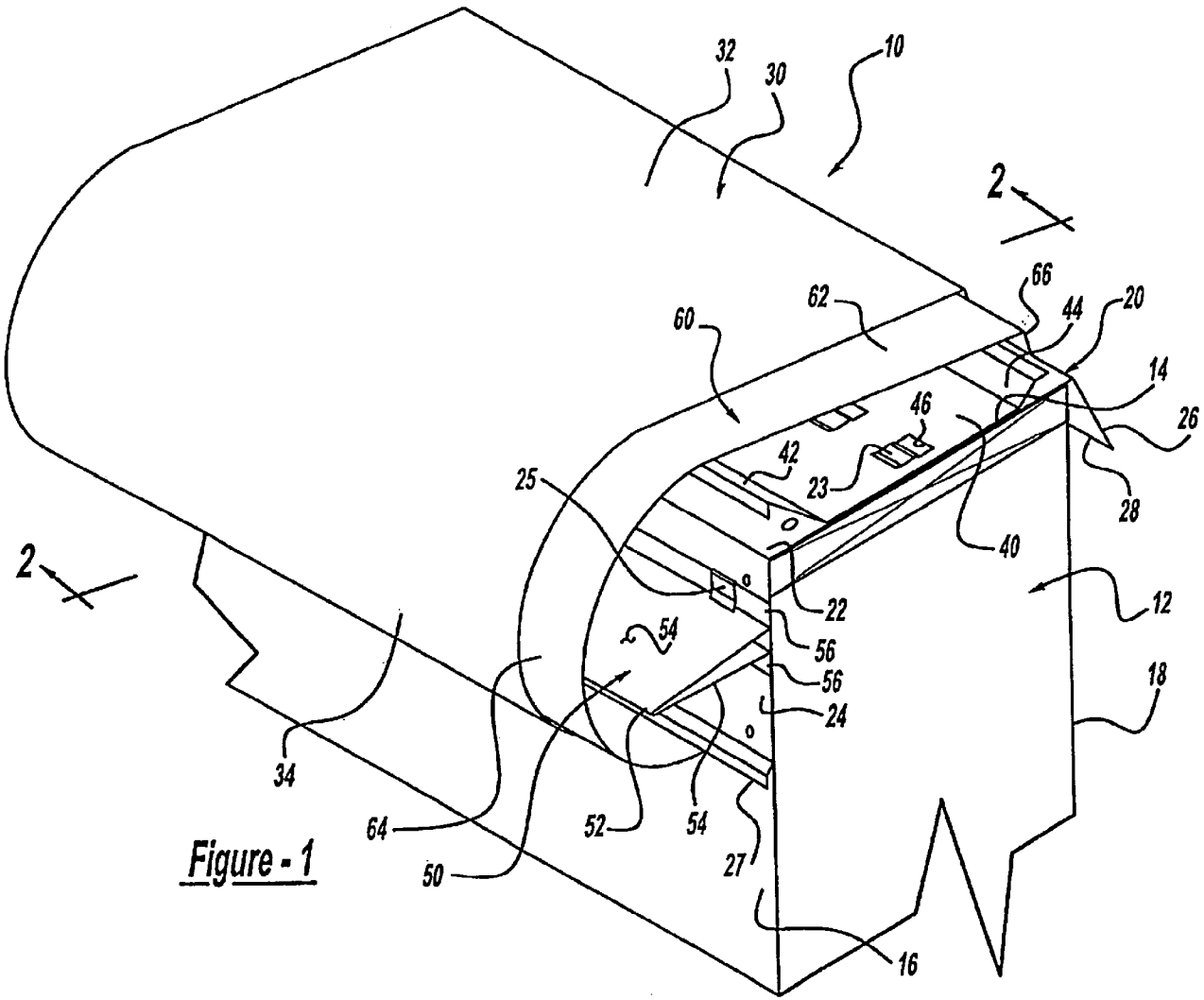
FIG. 1 is a partial, detailed perspective view of a portion of a coping assembly according to the present invention installed upon an exemplary parapet wall.
Figure 2:
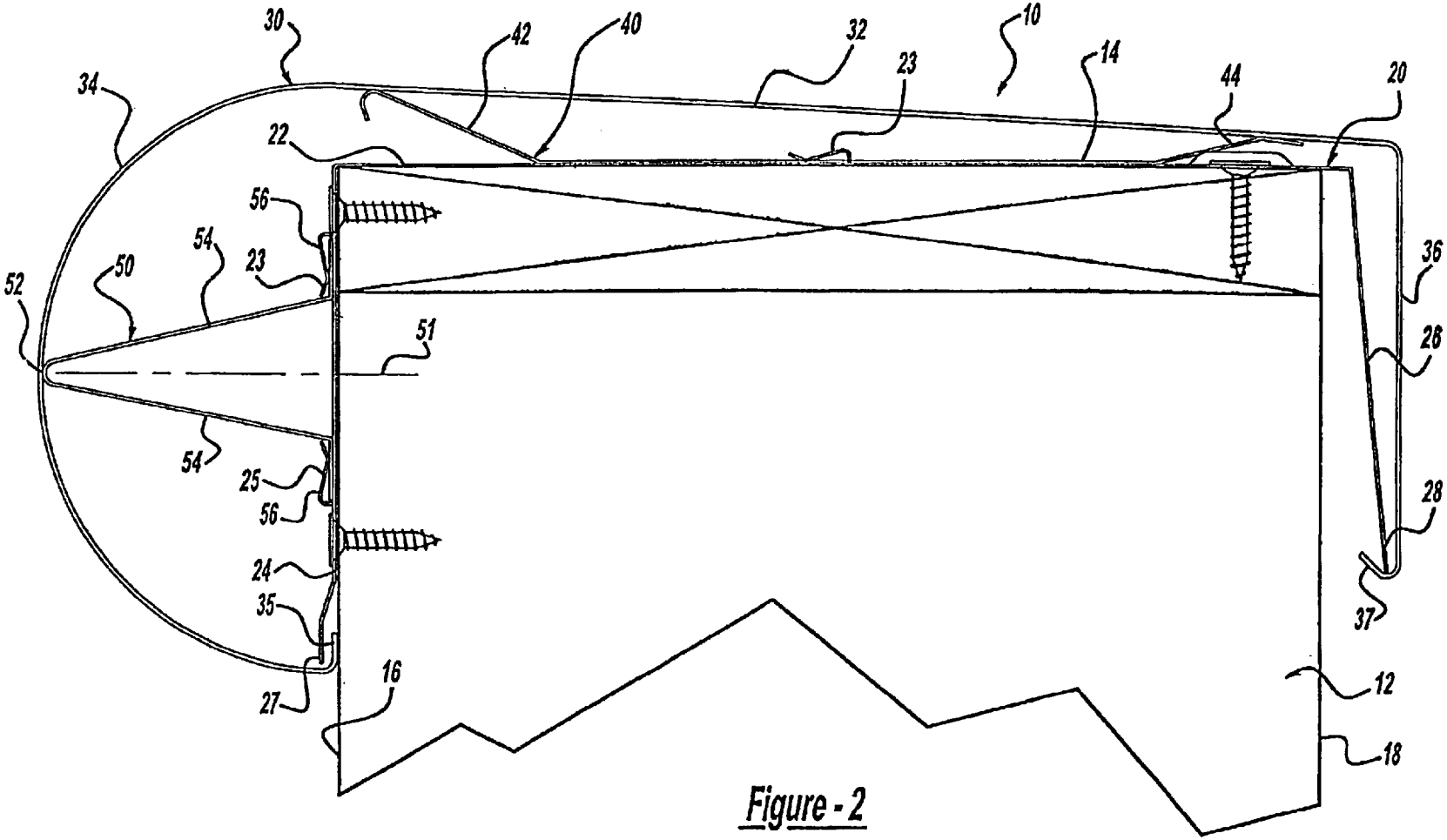
FIG. 2 is a lateral cross-sectional view, taken generally along line 2—2 of FIG. 1.
Figure 3:
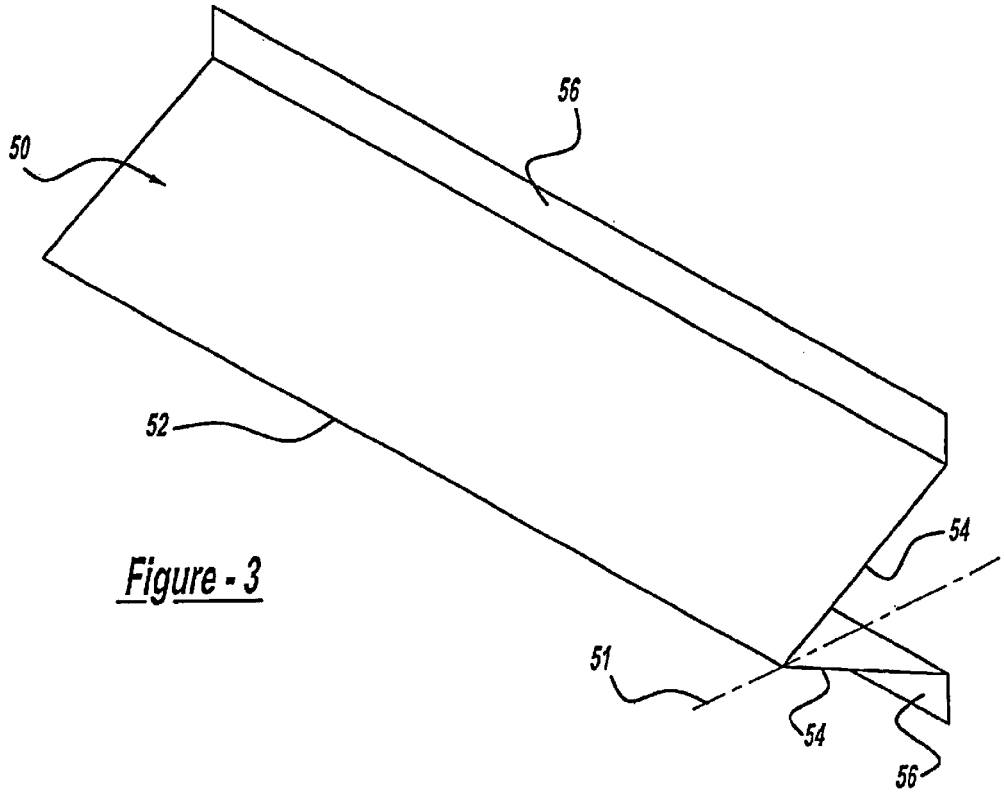
FIG. 3 is a perspective view of a portion of the coping cap locator member of FIGS. 1 and 2.
Figure 4:
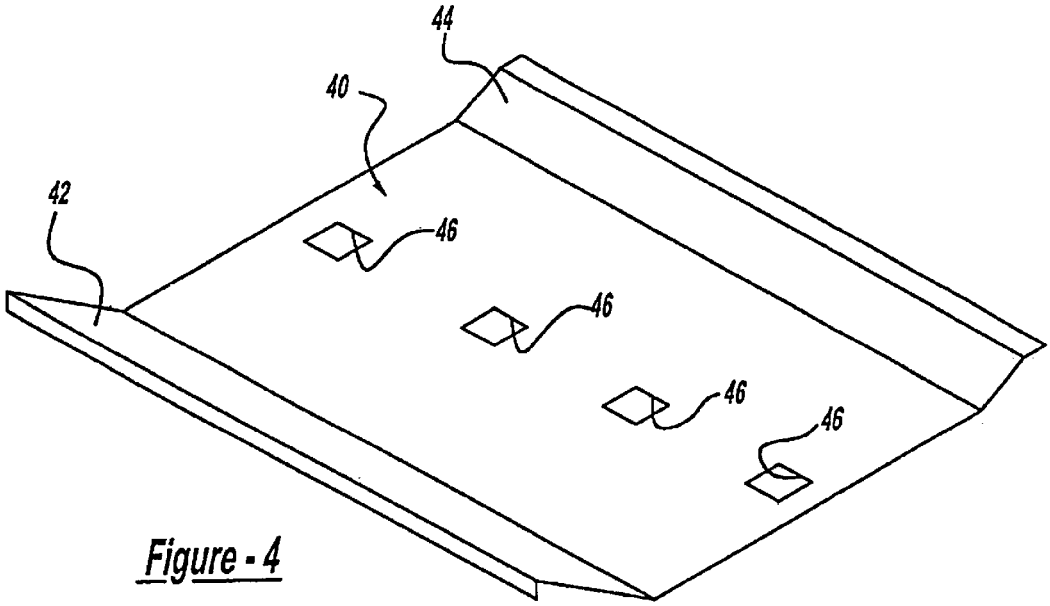
FIG. 4 is a perspective view of the spring clip member of FIGS. 1 and 2.

FIGS. 1 through 20 illustrate various embodiments of a coping assembly according to the present invention, shown merely for purposes of illustration as installed on various configurations of parapet walls, cant dams, or gravel stops. One skilled in the art will readily recognize, however, that the principles of the present invention are equally applicable to other coping assemblies having lateral cross-sections varying from those shown for purposes of illustration in the drawings, as well as for installation on other configurations of raised protrusions extending generally upwardly from any portion of the roof of a building.

FIGS. 1 through 4 illustrate one preferred embodiment of a coping assembly 10, shown merely for purposes of illustration as installed upon a parapet wall 12 such as that frequently found running along or adjacent to the edge of a building roof, as well as on other inboard roof areas. The parapet wall 12 includes a parapet upper surface 14, a parapet outer face 16, and a parapet inner face 18. It should be noted that the designations "outer" and "inner" are used herein are for convenience of reference to the drawing figures and do not necessarily refer to the side of a structure or component oriented toward the outer or inner portions, respectively, of the building roof.

A coping cleat 20 is adapted for being fixedly secured to the parapet wall 12, or other such raised protrusion, extending longitudinally along the roof of a building. The coping cleat 20 includes an upper cleat portion 22 extending generally horizontally in this embodiment across the generally horizontal illustrative parapet upper surface 14. An outer cleat portion 24 extends generally downwardly along or adjacent to the parapet outer face 16 on one side of the upper cleat portion 22, and an inner cleat portion 26 extends generally downwardly from an opposite side of the upper cleat portion 22 along or adjacent to the parapet inner face 18.

A coping cap 30 is interlockingly installed upon the coping cleat 20, preferably in a snap-on engagement therewith by way of its generally hook-shaped outer and inner cap edges 35 and 37 in snap-on engagement with respective outer and inner cleat edges 27 and 28. The coping cap 30 includes an upper cap portion 32, an outer cap portion 34 extending generally downwardly from one side of the upper cap portion 32, and an inner cap portion 36 extending generally downwardly from an opposite or inner side of the upper cap portion 32. In the particular embodiment illustrated in FIGS. 1 through 4, the outer cap portion 34 is fabricated in a generally semi-circular or "bullnose" configuration. It should be noted that other shapes can be used in the present invention and that such bullnose or other cross-sectional shapes can be used on either or both of the outer and inner sides of the assembly.

A spring clip 40 is secured to the coping cleat 20 and includes one or more of the resilient spring clip protrusions 42 and 44 resiliently engaging respective portions of the underside of the coping cap 30. The spring clip 40 is preferably secured to the coping cleat 20 by way of a number of cleat tabs 23 spaced longitudinally along the upper cleat portion 22 with each of the cleat tabs 23 extending through corresponding longitudinally spaced-apart spring clip openings 46 in order to tightly engage and secure the spring clip 40. It should be noted though that other fastening arrangements can alternatively be used to secure the spring clip 40 to the coping cleat 20. The arrangement depicted in FIGS. 1 through 4, however, is believed to be highly advantageous in terms of speed, ease, and economy of installation.

A coping locator member 50, which is preferably symmetrical with respect to a line 51 normal to the face of the parapet wall 12, is of a generally triangular lateral cross-sectional shape in the embodiment of FIGS. 1 through 4, with a locator apex 52 between two equal-length locator sides 54. In the embodiment of FIGS. 1 through 4, the coping locator 50 is preferably secured to the face of the coping cleat 20 by way of spaced-apart, oppositely-facing outer cleat tabs 25. In this configuration, which is believed to result in quick, easy, and economical installation, the locator sides 54 are merely squeezed toward one another until respective locator flanges 56 can clear the cleat tabs 25, whereupon the locator sides 54 are released such that the locator flanges are captured and secured by the cleat tabs 25, providing a tight, rattle-free securement. The preferred generally symmetrical configuration of the coping locator 50 also maintains the illustrative bullnose outer cap portion 34 in a uniform predetermined lateral cross-sectional shape and at a predetermined spacing from the face of the parapet wall 12.

As mentioned above, the coping assembly 10 is typically fabricated in longitudinal sections of a predetermined length. In order to provide the above-mentioned advantages of the invention in installations requiring more than one coping cap sections, a joint cover 60, illustrated in FIG. 1, is provided to bridge the longitudinal abutment of adjacent coping cap sections. The joint cover 60 preferably includes an upper joint cover portion 62, an outer joint cover portion 64, and an inner joint cover portion 66. In its preferred form, the joint cover 60 has substantially the same lateral cross-sectional shape as the coping cap 30, but sized slightly smaller so it can be disposed between the coping cap 30 and the coping cleat 20, as well as between the coping cap 30 and the spring clip 40. Perhaps even more importantly, though, such complementary cross-sectional shape of the joint cover 60 and the coping cap 30 allows the joint cover 60 to also be disposed between the coping cap 30 and the coping locator 50, thus substantially assuring proper alignment between adjacent coping cap sections, as well as providing structural support for the abutting joint and maintenance of the desired lateral cross sectional shape. In all of the embodiments discussed herein, tab-type securements, driven or threaded fastener securements, and welding securements are interchangeable with one another.

As mentioned above, FIGS. 5 through 20 illustrate a number of alternative embodiments of the present invention, wherein identical, similar or corresponding components are indicated by reference numerals corresponding to those of FIGS. 1 through 4 but having respective reference numeral prefixes ranging from one-hundred to twelve-hundred in FIGS. 5 through 20. In most if not all respects, however, such correspondingly-numbered elements perform substantially the same, or at least similar, functions as those of FIGS. 1 through 4.

Figure 5:
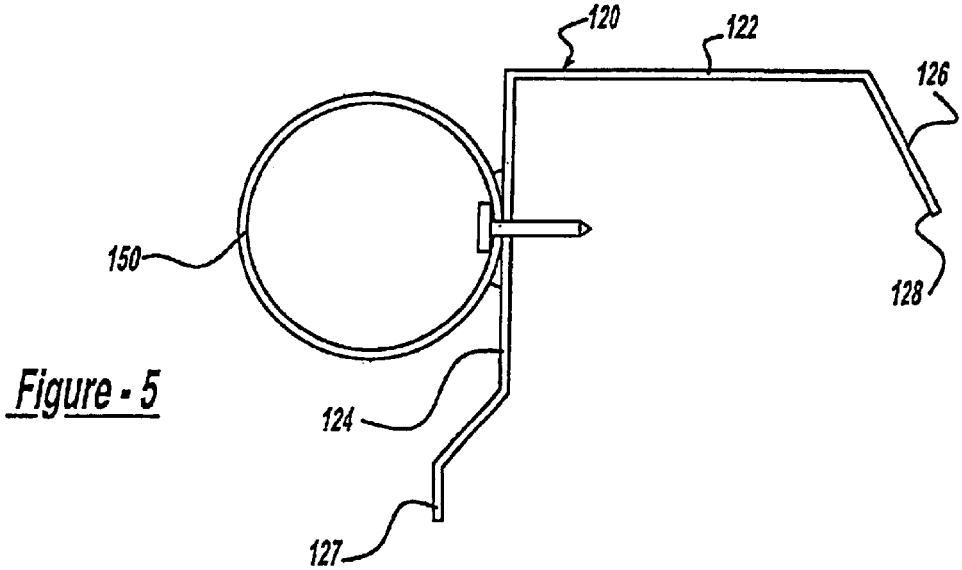
FIGS. 5 through 10 are illustrative diagrammatic lateral cross-sectional views of various alternative embodiments of a coping assembly according to the present invention, all of which can to be used in conjunction with a coping cap of the same or similar general configuration as that of FIGS. 1 and 2.

FIG. 5 diagrammatically illustrates only the coping cleat 120 and the coping locator 150, and is adapted for use in conjunction with coping caps and coping covers similar or identical to those of FIGS. 1 through 4. In FIG. 5, the generally triangular-shaped coping locator 50 is replaced by a generally cylindrical, but still symmetrical, coping locator 150 secured to the outer cleat portion 124.

Figure 6:
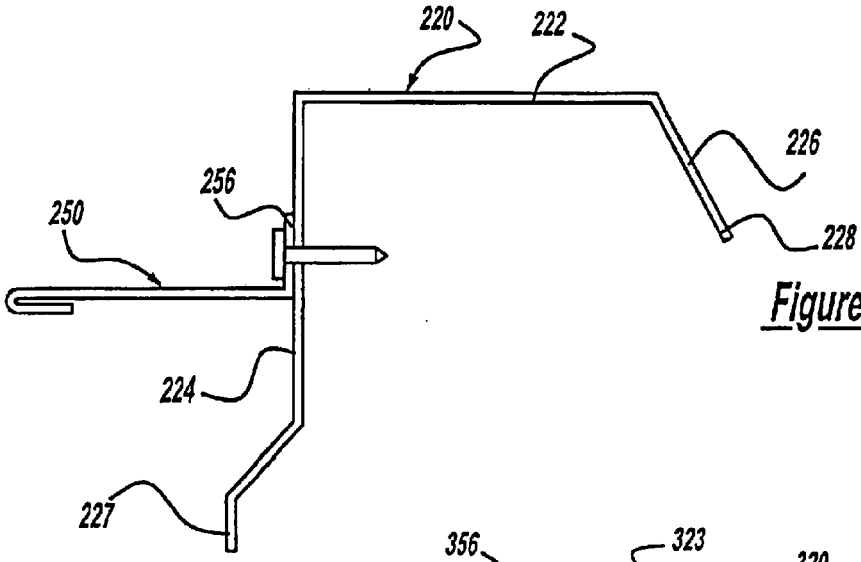

In FIG. 6, an alternative coping locator 250 is shown installed on a coping cleat 220 by way of a nail or threaded fastener extending through the locator flange 256 and through the outer cleat portion 224. It should be noted that the outer end of the coping locator 250 is folded over merely for purposes of keeping its outer end from abrading or otherwise damaging the coping cap 230. In terms of its structural support and its capabilities of maintaining the coping cap in a predetermined cross-sectional shape, the outwardly-protruding portion of the coping cap locator 250 is considered to be substantially symmetrical with respect to a line normal to the outer face of the outer cleat portion 224.

Figure 7:
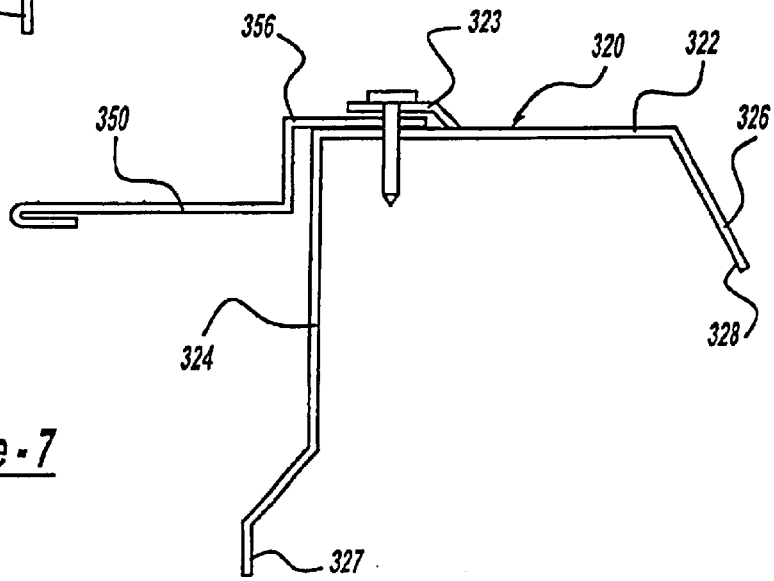

FIG. 7 illustrates yet another embodiment, similar to that of FIG. 6, except that the coping locator 350 is secured to the coping cleat 320 by way of a locator flange 356 which can be captured and secured by an upper cleat tab 323 and/or a driven or threaded fastener or even by welding methods, such as TIG, MIG, or spot welding. It should further be noted that in any of the alternate embodiments of FIGS. 5 through 10, such a cleat tab securing arrangement can be provided and/or a driven or threaded fastener can be used.

Figure 8:
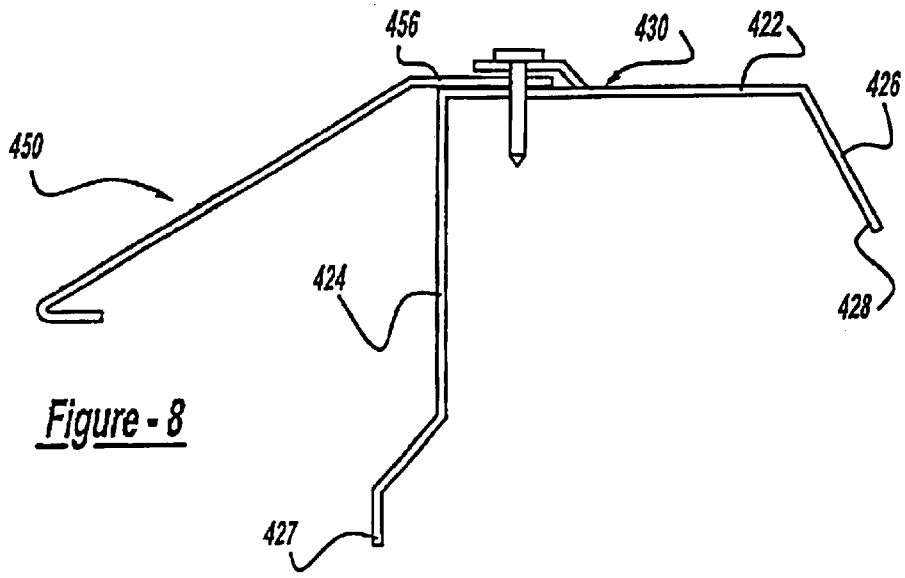

FIG. 8 illustrates an arrangement similar to that of the alternative embodiment of FIG. 7, except that the outwardly-protruding portion of the coping locator 450 extends generally outwardly and downwardly with respect to the outer cleat portion 424 of the coping cleat 420. This arrangement is especially well-suited for installations where greater coping locator lateral flexibility may be deemed to be advantageous or desired.

Figure 9:
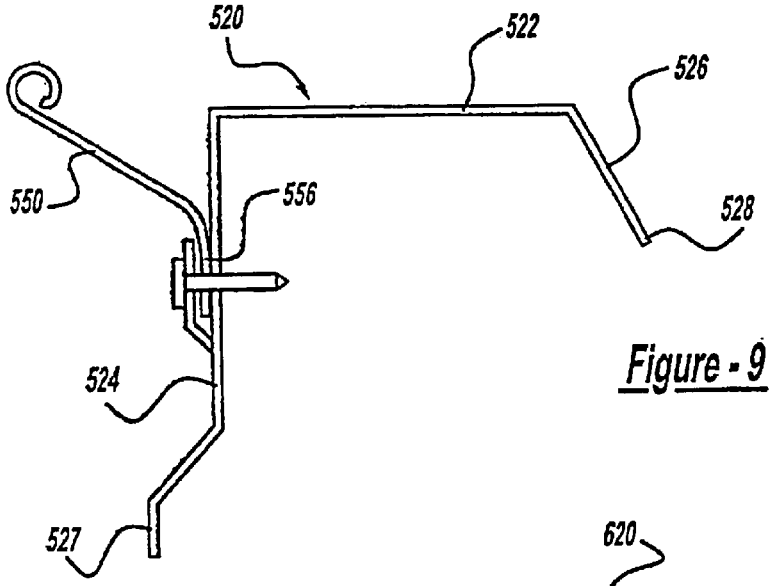

FIG. 9 illustrates a coping locator 550 similar to that of FIG. 8, but with its outwardly-protruding portion extending generally outwardly and upwardly from the outer cleat portion 524 of the coping cleat 520.

Figure 10:
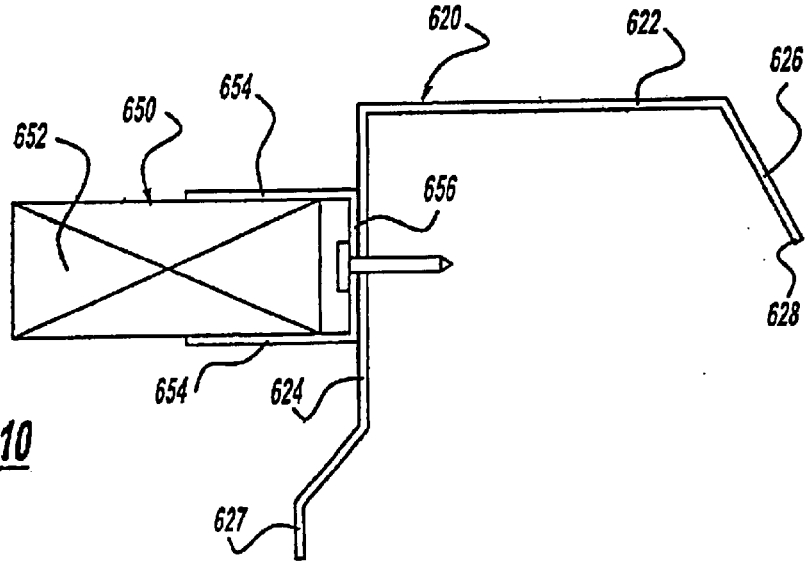

In FIG. 10, still another alternate arrangement includes a symmetrical coping locator assembly 650, having a two-piece configuration. In FIG. 10, the outwardly-protruding portion of the coping locator assembly 650 is composed of wood or other suitable building material and is grippingly secured in place by a pair of spaced-apart coping locator sides 654 that extend horizontally outwardly from a coping locator flange portion 656.

Figure 11:
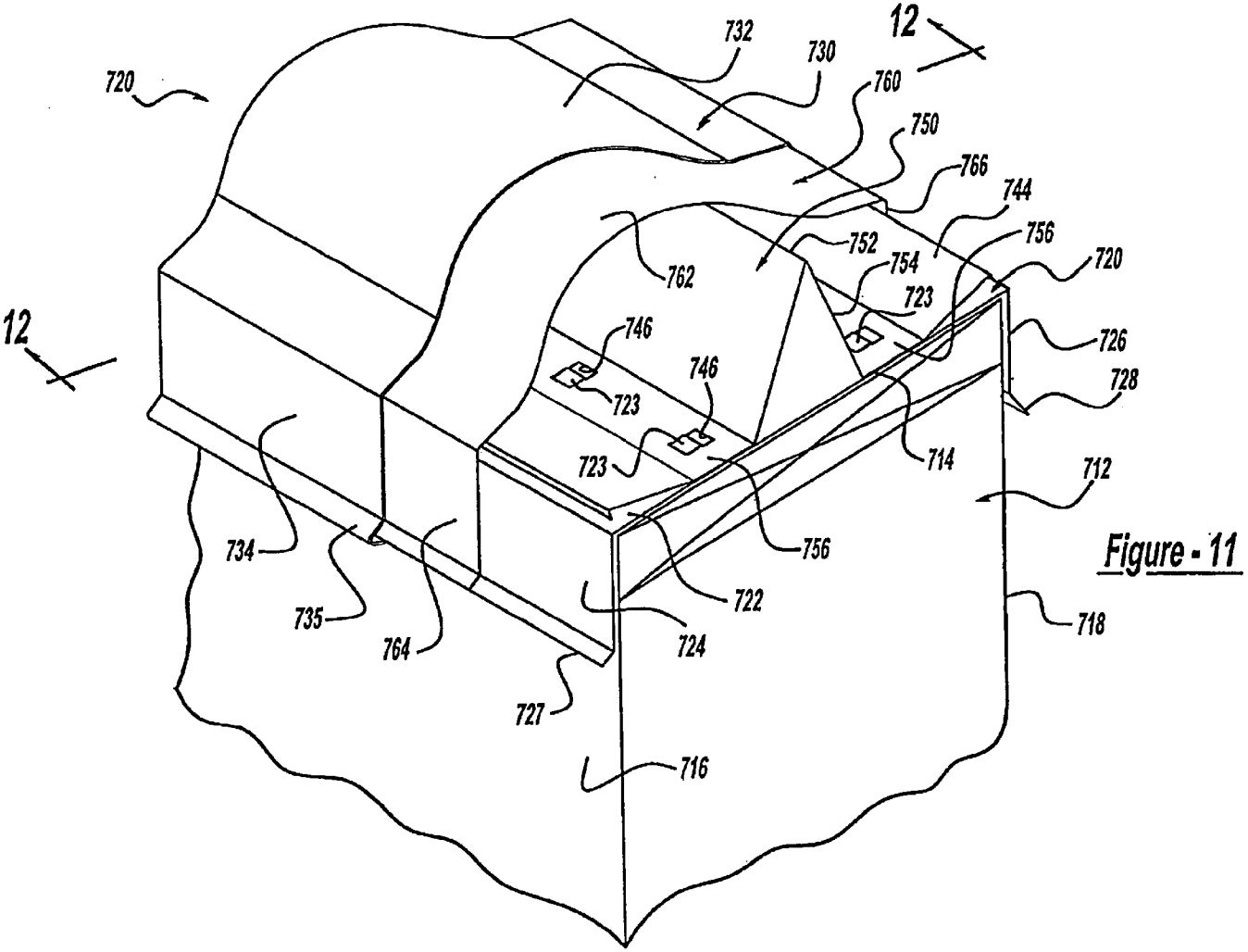
FIG. 11 illustrates yet another alternative embodiment of a coping assembly according to the present invention, shown in a partial, detailed perspective view similar to that of FIG. 1.
Figure 12:
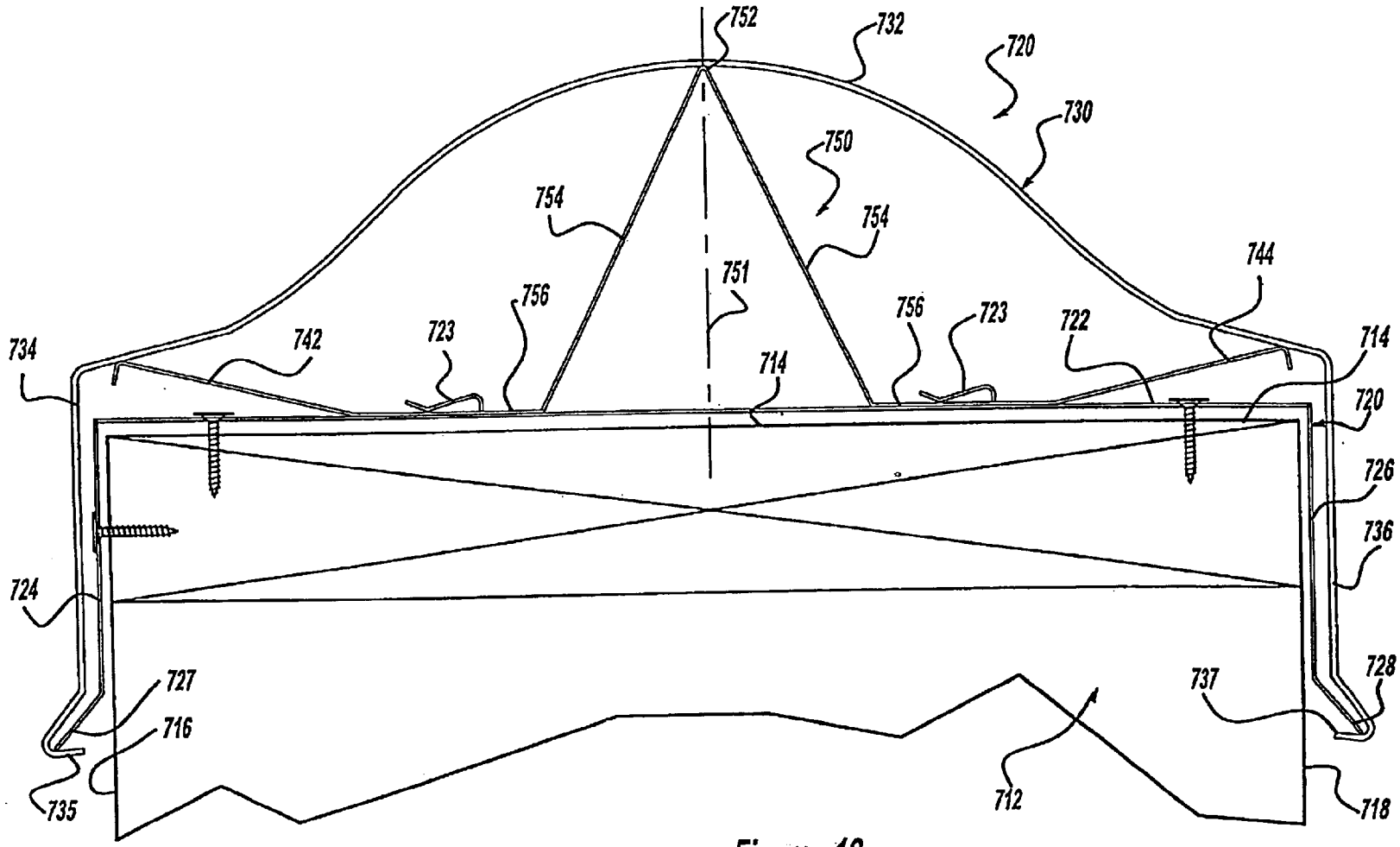
FIG. 12 is a lateral cross-sectional view, taken generally along line 12—12 of FIG. 11.
Figure 13:
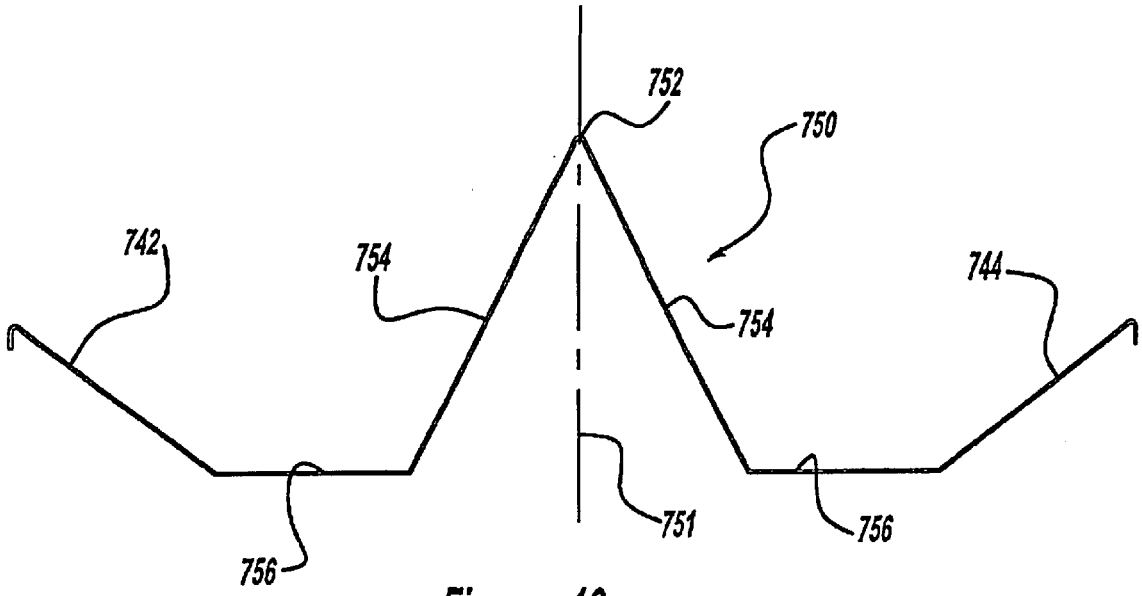
FIG. 13 is a lateral cross-sectional view of the combination spring clip and cap locator member of FIGS. 11 and 12.

FIGS. 11 through 13 illustrate a somewhat more diverse alternate embodiment of the present invention, having a coping assembly 720 that includes a coping cap 730 that straddles and overlies the outer and inner sides 724 and 726, respectively, of the coping cleat 720. The upper coping cap portion 732 is generally "peaked" or "humped" in lateral cross-sectional shape. In this embodiment, a pair of oppositely-facing sloped resilient spring protrusions 742 and 744 are incorporated into the coping locator 750 and resiliently engage the undersides of the coping cap 730 and the joint cover 760 at the abutment of longitudinally adjacent coping cap sections. The coping locator 750 is secured to the coping cleat 720 and is symmetrical with respect to a line 751 extending in a normal direction with respect to the upper parapet surface 714 of the parapet wall 712. Thus, in the embodiment illustrated in FIGS. 11 through 13, the coping locator 750 also has a locator apex 752 that engages the undersides of both the coping cap 730 and the joint cover 760 in order to maintain the above-discussed predetermined cross-sectional shape, vertical spacing from the parapet wall 712, as well as the proper alignment between 1; longitudinally-adjacent coping cap sections.

Figure 14:
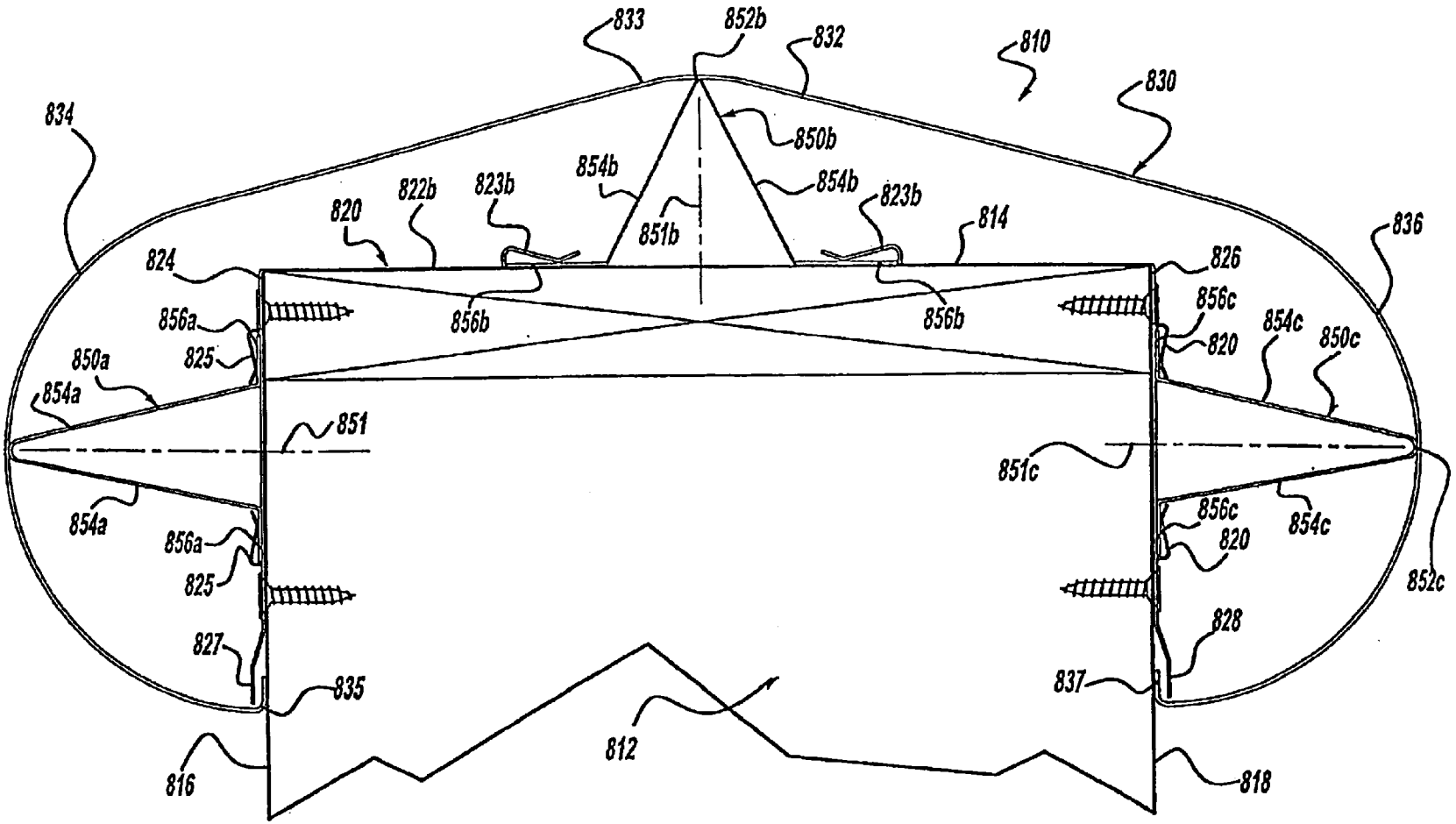
FIGS. 14 through 17 are lateral cross-sectional views, somewhat similar to that of FIG. 12, but illustrating still further alternate embodiments of the present invention.

FIG. 14 illustrates yet another alternate embodiment of the present invention, generally similar to that of FIGS. 11 through 13, except that three coping locators 850*a*, 850*b*, and 850*c*, are provided for engagement with the undersides of the coping cap 830 and its complementary and associated joint cover (not shown).

Figure 15:
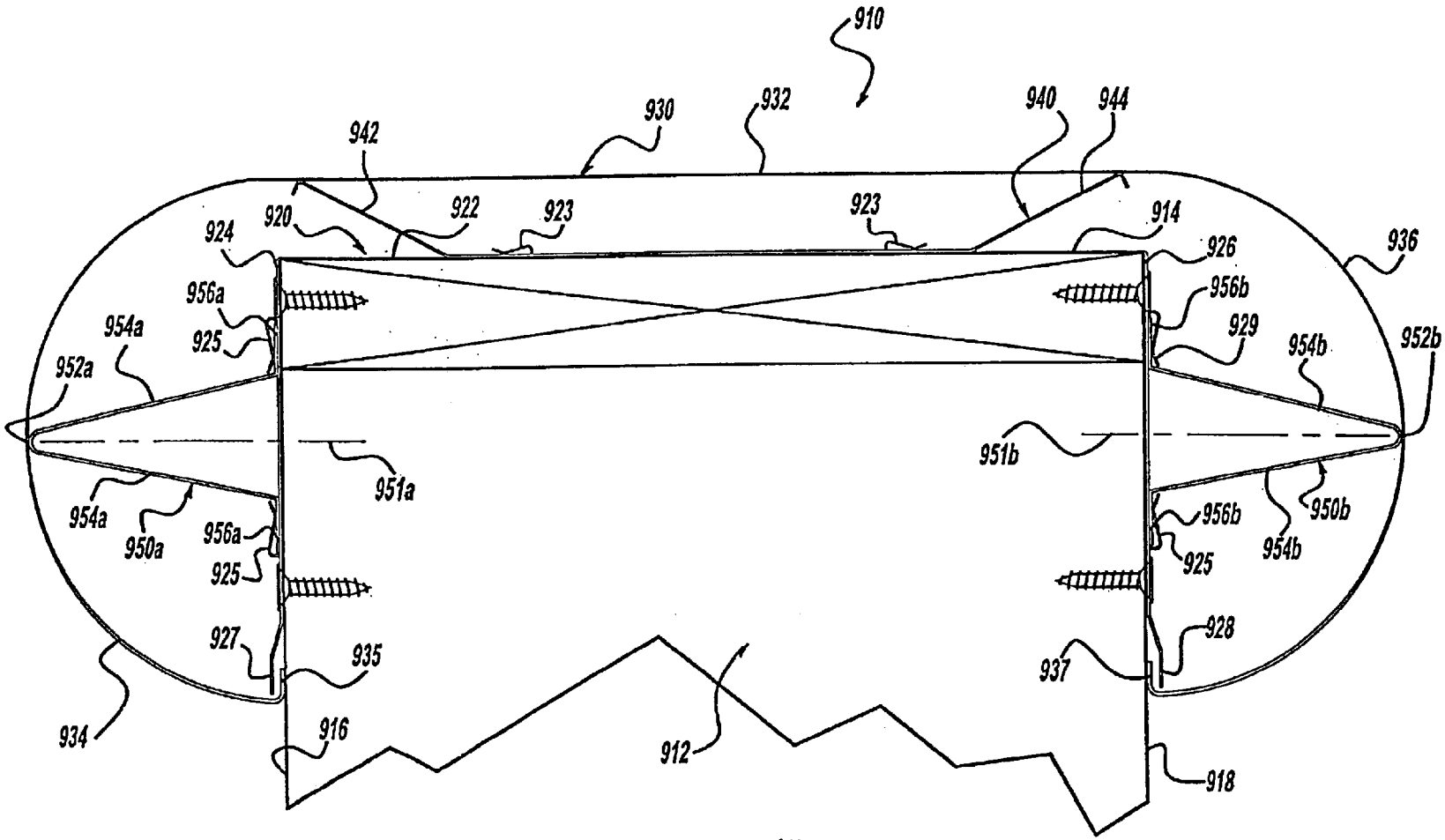

In FIG. 15, still another alternate embodiment is somewhat similar to that of FIG. 14, except that the peaked upper portion of the coping cap 830 is eliminated and replaced by a generally horizontal and generally flat upper cap portion 932. Thus, only the two coping locators 950*a* and 950*b* are typically required. It should be noted, however, that a third coping locator could alternatively be provided on the upper cleat portion 922 for engagement with the underside of the upper cap portion 932 and the complementary joint cover (not shown).

Figure 16:
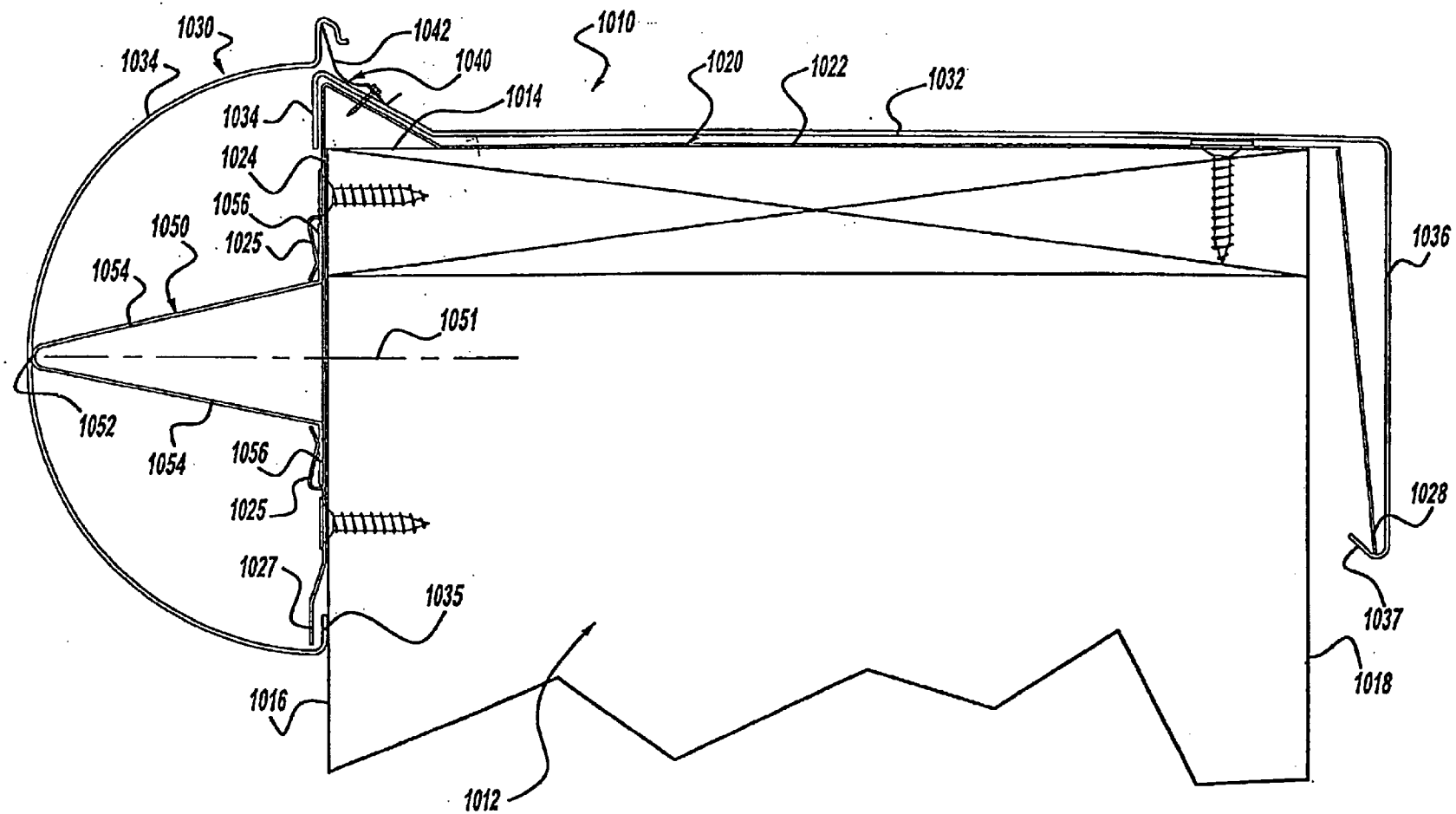

In FIG. 16, another somewhat diverse alternate embodiment of the present invention is illustrated with the coping cap 1030 being formed in a two-piece assembly separated generally between the outer cap portion 1034 and the upper cap portion 1032. In addition, the coping cleat 1020 is formed of a configuration having a gravel stop or cant dam configuration with the upper cleat portion 1022 having an upwardly and outwardly sloped portion extending toward the outer cleat portion 1024. In this embodiment, a somewhat different spring clip 1040 is secured to such upwardly and outwardly sloping portion of the coping cleat 1020 as well as to a similarly upwardly and outwardly sloping portion of the upper cap portion 1032 of the coping cap assembly 1030. Such securement of the spring clip 1040 can be accomplished by way of threaded fasteners, as illustrated in FIG. 16, or by way of gripping tabs on the coping cap 1030 and/or on the coping cleat 1020, with the tabs extending through spaced-apart openings in the spring clip 1040, similar to those discussed above in connection with previously-described embodiments.

Figure 17:
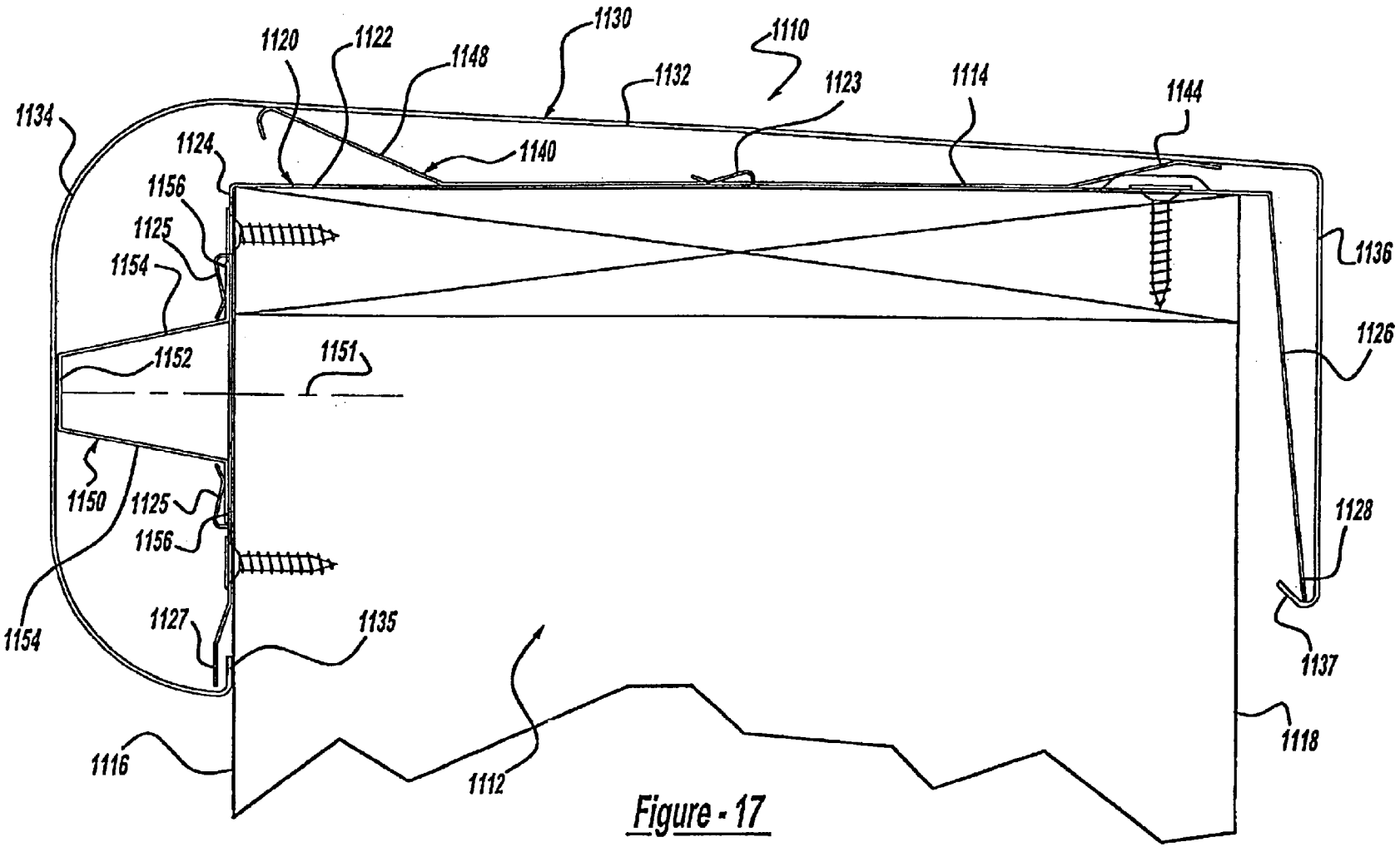

FIG. 17 illustrates still another alternate embodiment of the present invention, wherein the outer cap portion 1134 of the coping cap 1130 has a generally vertically-extending flat portion. In such an embodiment, the symmetrical coping locator has a correspondingly generally flat outer locator "apex-like" portion 1152 between the locator sides 1154. In other respects, the elements of this and the previously-discussed alternate embodiments are generally similar in configuration and/or function to the elements depicted in the first-discussed embodiment of FIGS. 1 through 4.

Figure 18:
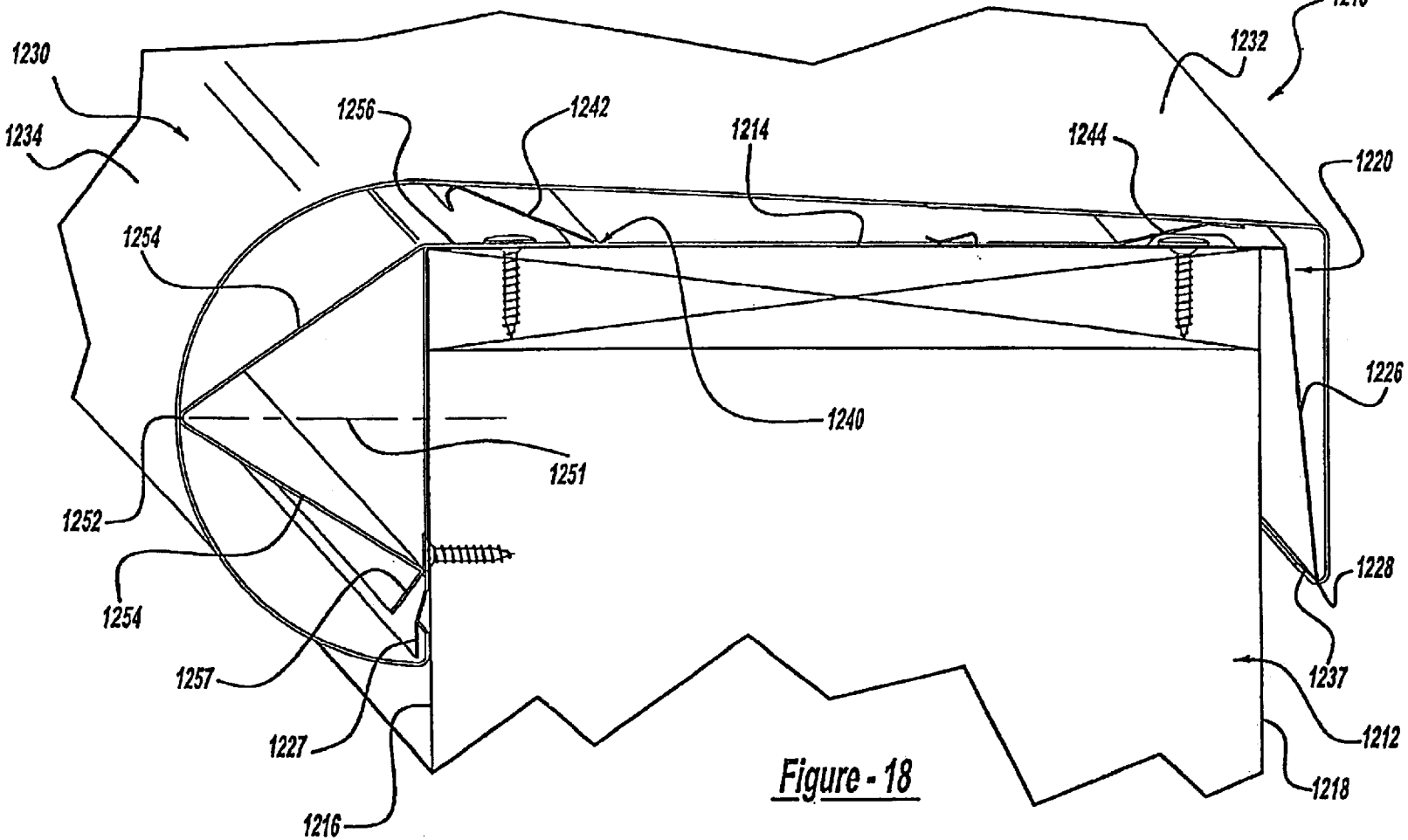
FIG. 18 is a partial perspective view of another preferred embodiment of a coping assembly according to the present invention.
Figure 19:
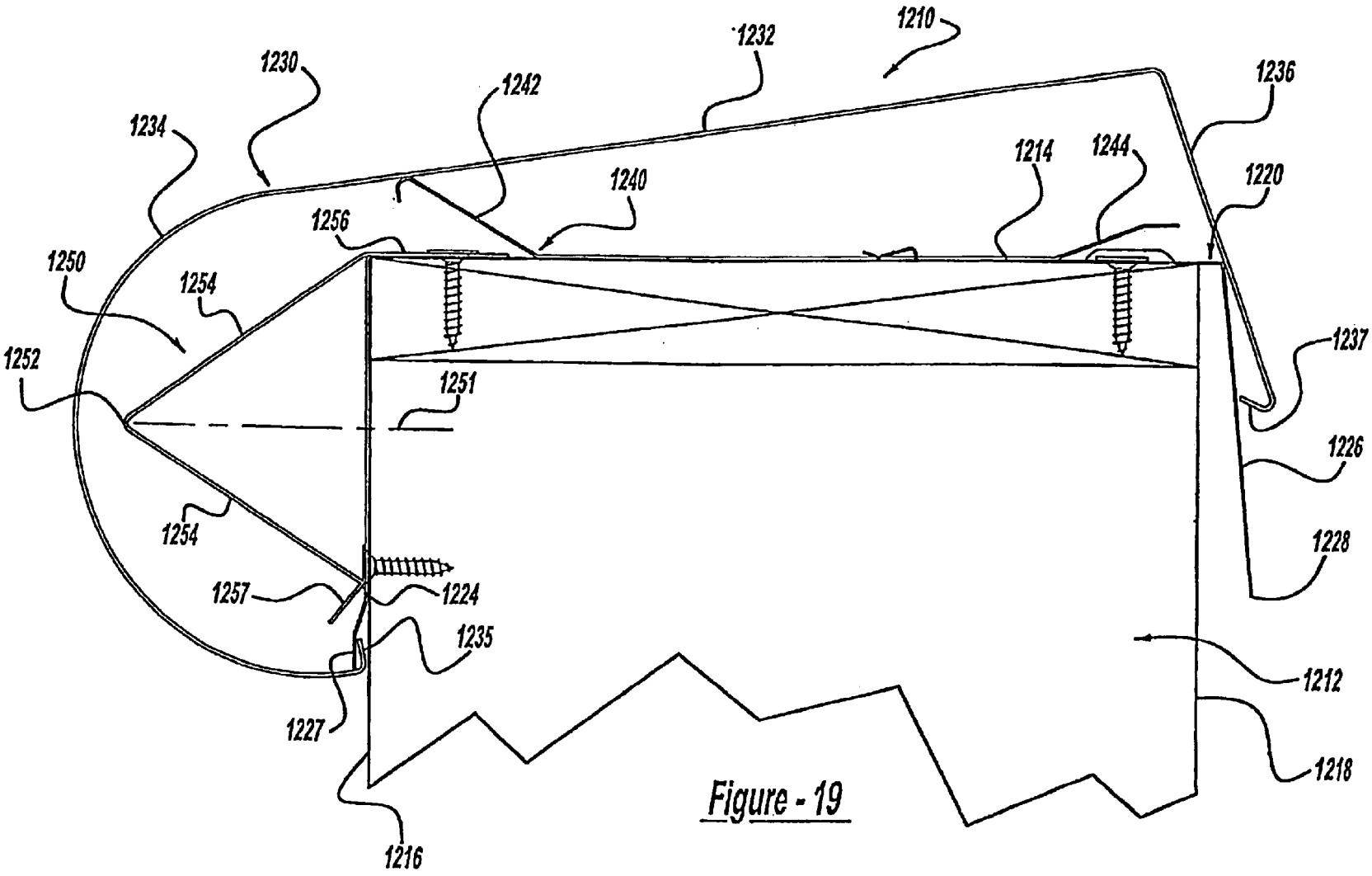
FIG. 19 is a cross-sectional view of the coping assembly of FIG. 18, but illustrating the installation of the coping member.
Figure 20:
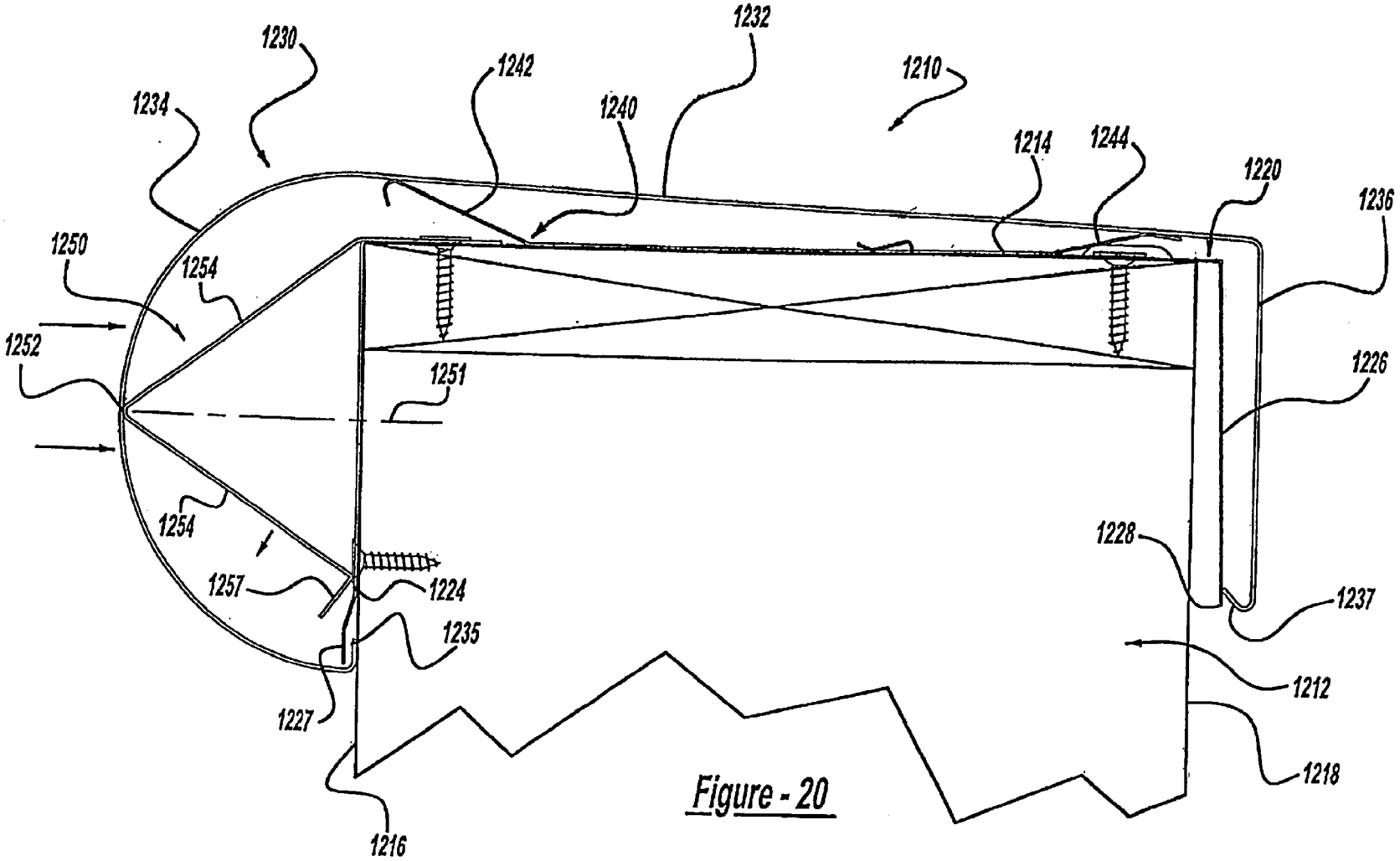
FIG. 20 is a cross-sectional view similar to that of FIG. 19, but illustrating the coping member just prior to its complete installation.

FIGS. 18 through 20 illustrate another preferred embodiment of the present invention, which is somewhat similar to the embodiment of FIGS. 1 through 4, but with the exceptions discussed below. It should be noted, however, that the embodiment depicted in FIGS. 18 through 19 is merely exemplary in that it shows a coping locator protruding outwardly and generally horizontally from the outer face of the cleat. The concepts shown in FIGS. 18 through 20, however, are equally applicable as a modification to any of the embodiments of the invention, including those having a coping locator (or locators) extending upwardly from the upper face of the cleat and/or outwardly or inwardly from the outer face or inner face of the cleat, respectively.

In FIGS. 18 through 20, the coping locators of FIGS. 1 through 17, for example, are replaced by a coping locator 1250, having upper and lower locator sides 1254. The coping locator 1250 preferably has a locator flange 1256 at the upper side edge of the upper locator side

1254 and a free-floating locator flange 1257 adjacent the lower side edge of the lower locator side 1254. In the exemplary embodiment of FIGS. 18 through 20, the lower locator side 1254 and the free-floating locator flange 1257 intersect transversely to form a free-floating locator side edge that is free to move or float relative to the coping cleat 1220.

Because of this arrangement, the coping locator 1250 is yieldable, or resiliently compressible, in order to better facilitate the ease of installation of the coping cap 1230. Such installation is illustrated in FIGS. 19 and 20, which show the coping cap near the beginning of its installation and just prior to its complete installation, respectively, onto the coping cleat 1220. This has been found to provide such ease of coping cap installation while still maintaining the necessary support and shape-maintenance functions of the coping locator for the coping cap.

In the preferred illustrative example shown in FIGS. 18 through 19, the preferred free-floating side edge, formed by the transverse intersection of the lower locator side 1254 and the free-floating locator flange 1257, is preferably in a slidable, free-floating contact or engagement with the coping cleat 1220. The coping locator 1250 is symmetrical about a line normal to the surface of the coping cleat 1220 and the wall 1212 from which it protrudes. Furthermore, the preferred coping locator 1250 shown in FIGS. 18 through 20 has a generally triangular lateral cross-sectional shape such that the normal line 1251 extends through the apex 1252 between two equal sides 1254 of the generally triangular cross-sectional shape of the coping locator 1250 at least before and after the installation of the coping cap 1230. In other respects, however, the coping assembly 1210 of FIGS. 18 through 20 is generally similar in function and/or configuration to the embodiments of FIGS. 1 through 17, which have fixed coping locator side edges rather than the free-floating side edge of the coping locator 1250. It should also be noted that the free-floating side edge of the coping locator 1250 can alternatively be in contact with, out of contact with, the coping cleat 1220 until installation of the coping cap 1230.

FIGS. 21 through 27 illustrate another preferred embodiment of the present invention which is somewhat similar to the embodiment of FIGS. 18 through 20, but with the exceptions discussed below. The embodiments of FIGS. 21 through 27 are especially well suited for the application of the principles of the present invention to fascias or other covers for roof edges, cant dams, gravel stops or other raised roof edge assemblies.

Figure 21:
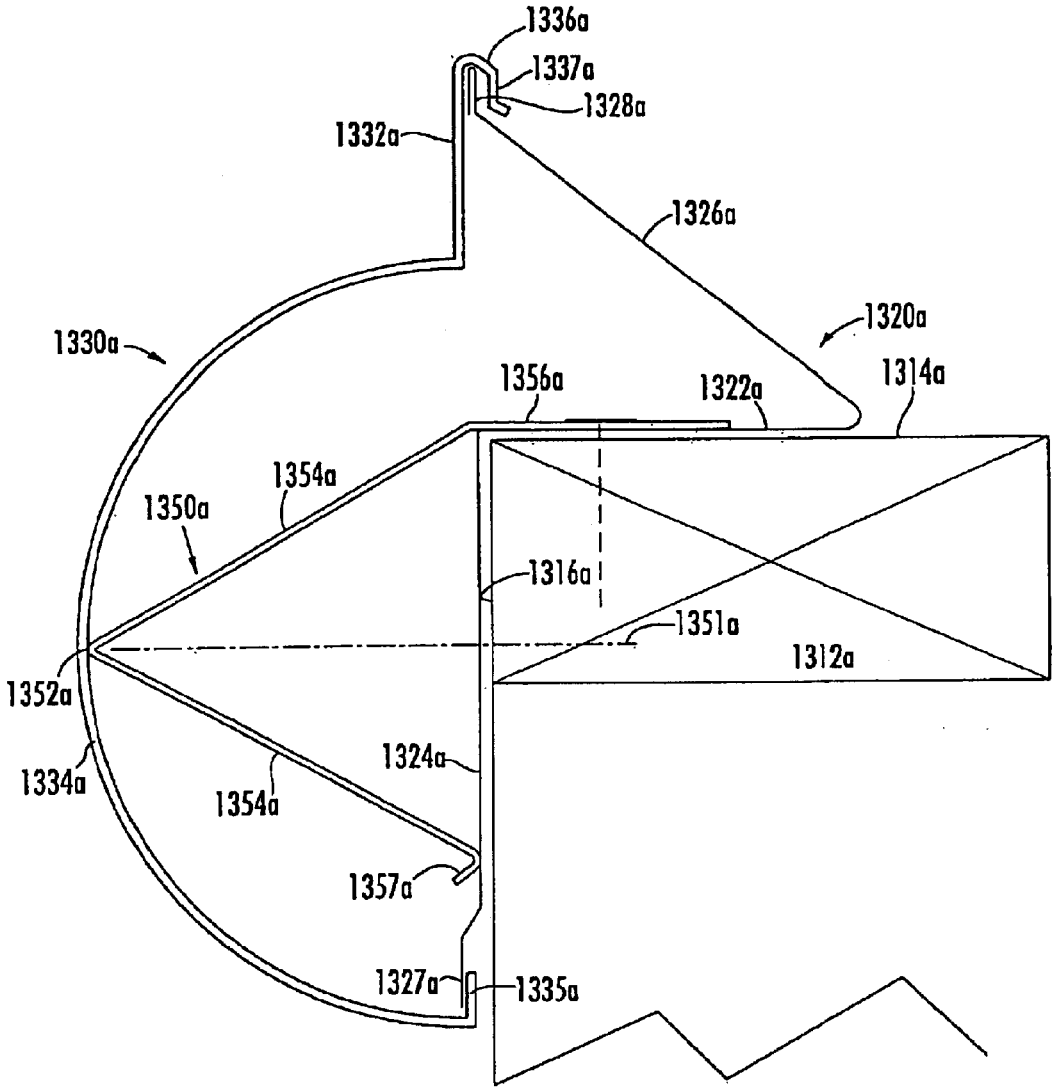
FIGS. 21 through 27 are lateral cross-sectional views illustrating alternate embodiments of a cover cap assembly according to the present invention.
Figure 22:
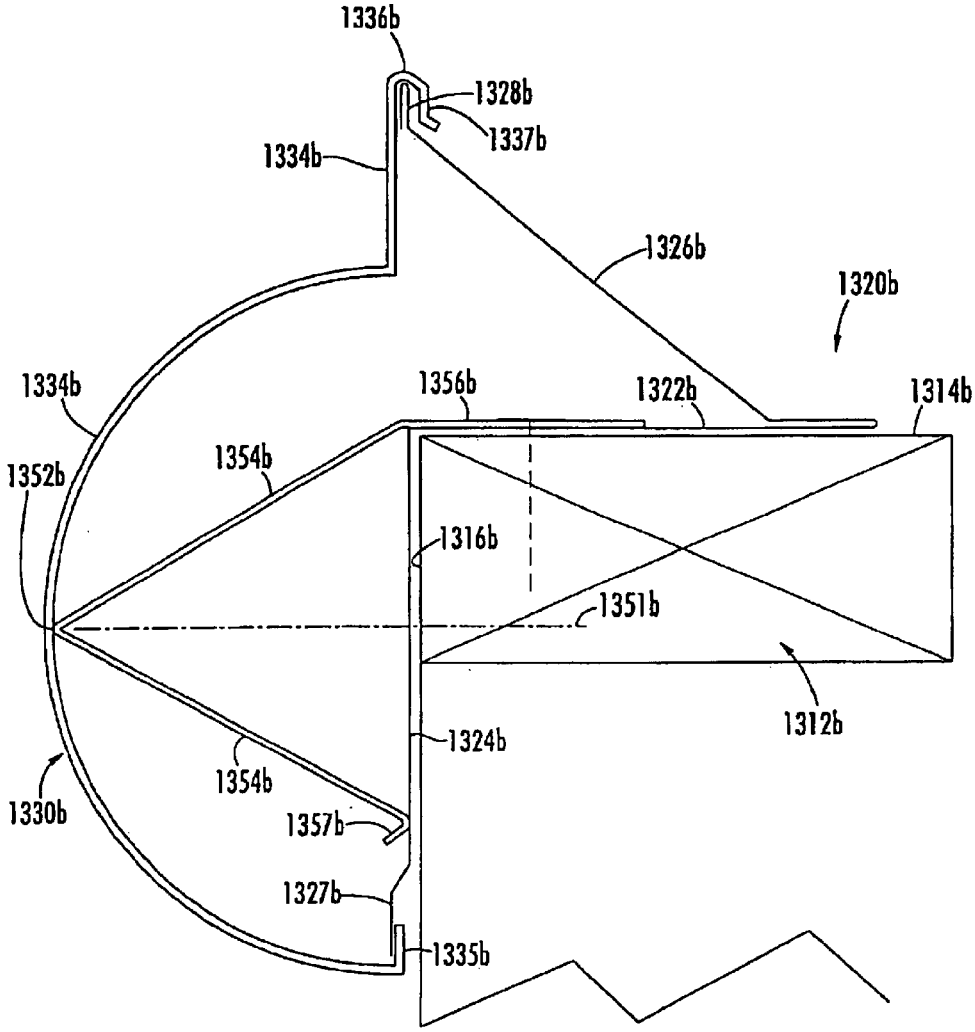
Figure 23:
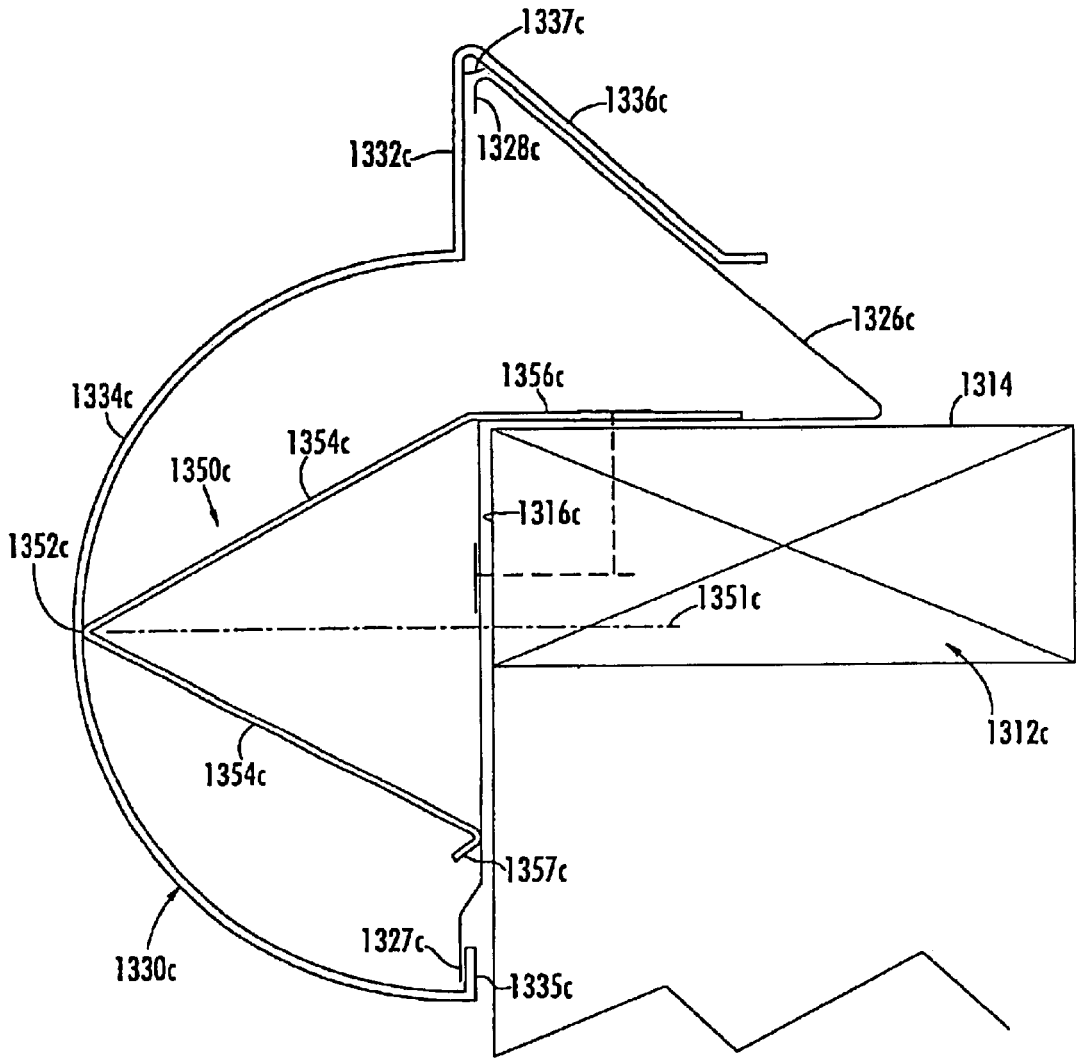

FIGS. 21 through 23 illustrate a number of alternative embodiments of the present invention, wherein identical, similar or corresponding components are indicated by reference numerals corresponding to those of FIGS. 1 through 20 but having the numeral prefix of thirteen-hundred and reference suffixes from 'a' to 'c'. In FIGS. 21 through 23, the outer cleat portion 1324 extends downwardly from the upper surface 1314 of the building structure and along the outer face 1316 of the building structure. The upper cleat portion 1322 extends horizontally along the upper surface 1314 of the building structure. The inner cleat portion 1326 extends generally upwardly and outwardly relative to the upper surface 1314 of the building structure. The cover cleat 1320 is attached to the building structure, preferably at least to the upper surface 1314 of the building structure. The outer and inner cover cap portions 1334 and 1336 are attached to the outer and inner cleat portions 1324 and 1326 in the snap-on arrangement illustrated in FIGS. 1 through 20. Similar to that discussed above, the free-floating locator flange 1357 is in a slidably free-floating contact or engagement with the cover cleat 1320.

Figure 24:
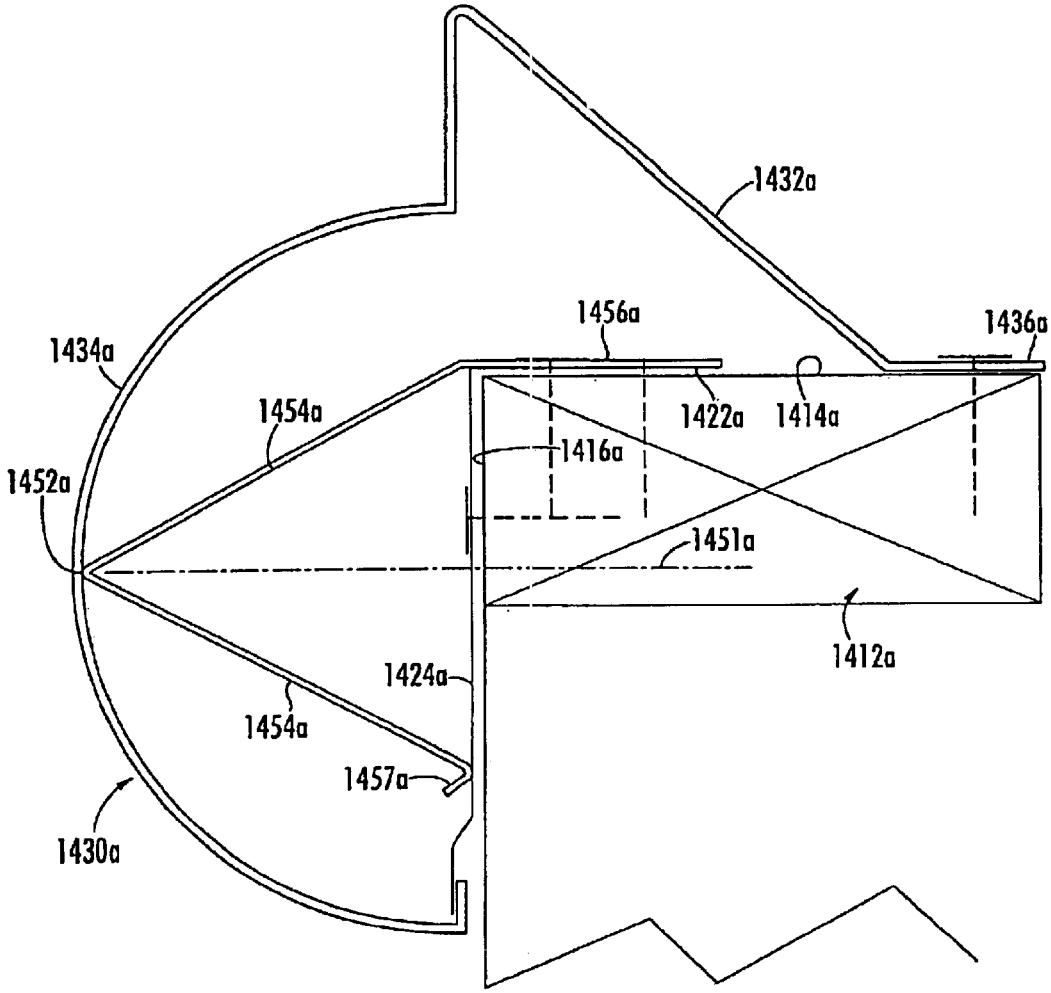
Figure 25:
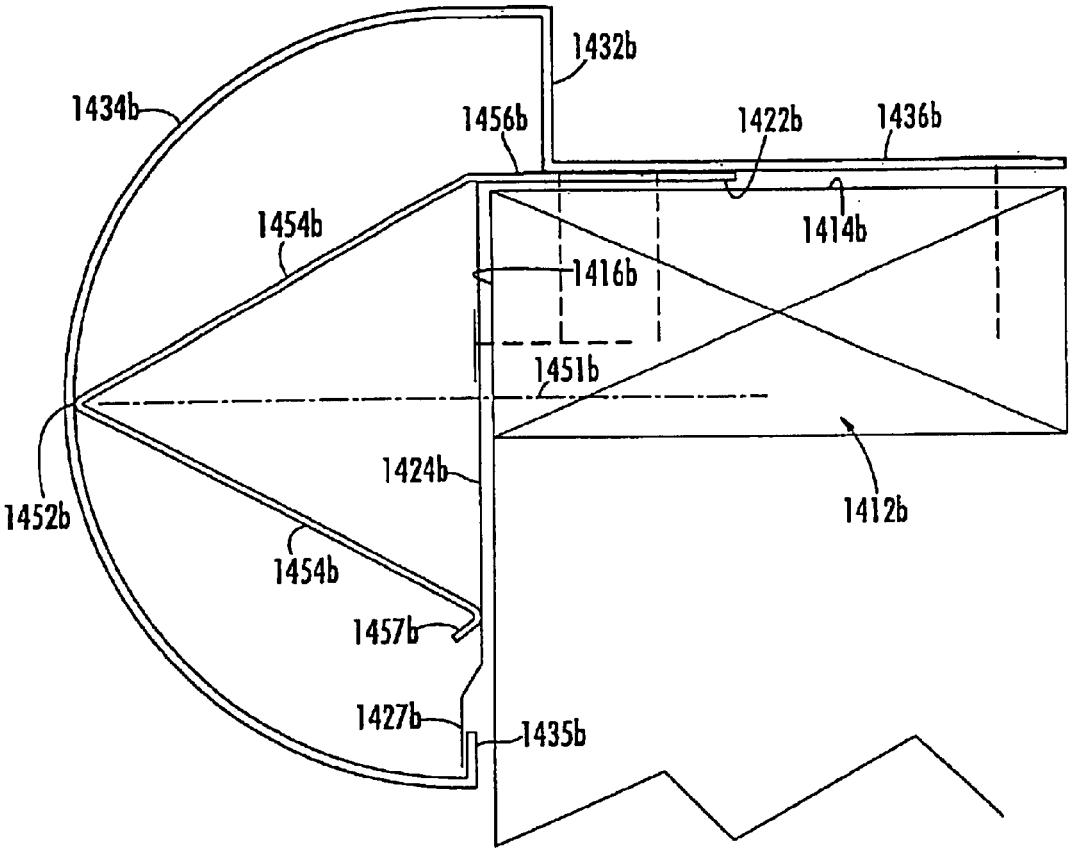
Figure 26:
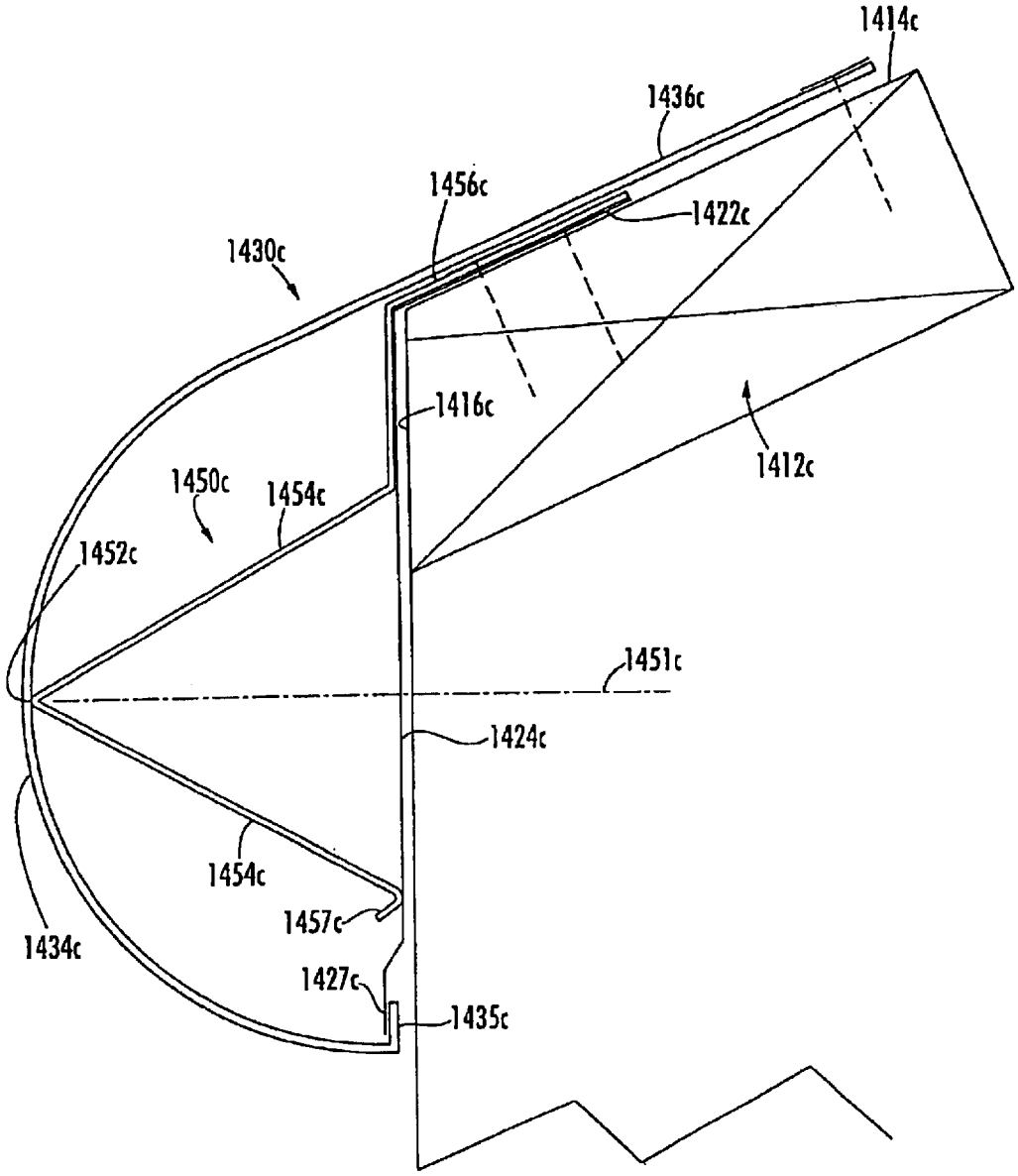

FIGS. 24 through 26 illustrate a number of alternative embodiments of the present invention, wherein identical, similar or corresponding components are indicated by reference numerals corresponding to those of FIGS. 21 through 23 but having the numeral prefix of fourteen-hundred and reference suffixes from 'a' to 'c'. In FIGS. 24 through 26, the inner cleat portion is eliminated. The inner cover cap portion 1436 extends adjacent to the upper cleat portion 1422 and is secured to the upper surface 1414 of the building structure, again with the free-floating locator flange 1457 as discussed above.

Figure 27:
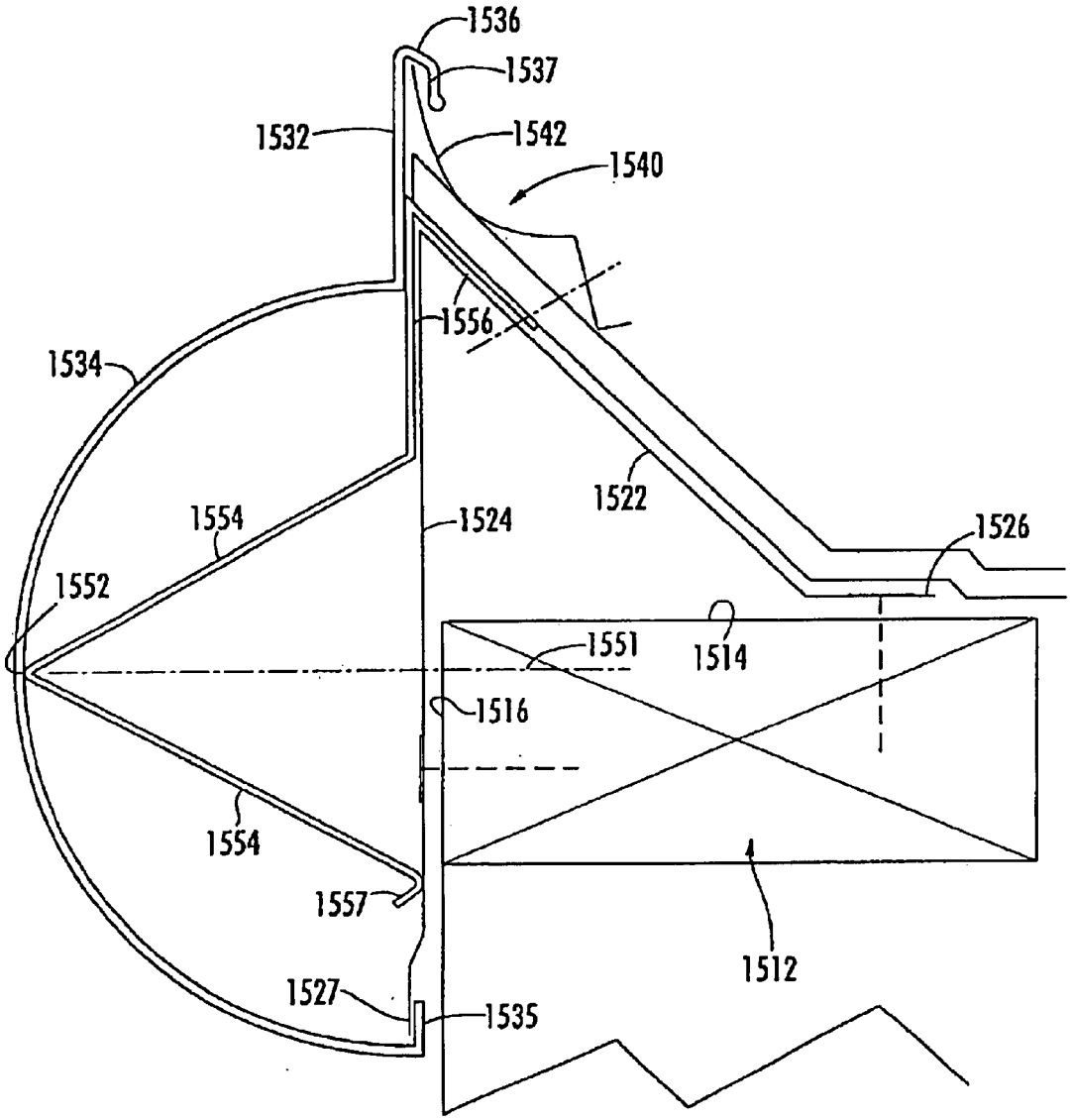

Finally, FIG. 27 illustrates an alternative embodiment of the present invention, wherein identical, similar or corresponding components are indicated by reference numerals corresponding to those of FIGS. 21 through 26 but having the numeral prefix of fifteen-hundred. In FIG. 27, the outer cleat portion 1524 extends upwardly beyond the upper surface 1514 of the roof structure, the upper cleat portion 1522 extends downwardly and inwardly relative to the upper surface 1514 of the building structure, and the inner cleat portion 1526 extends generally horizontally along the upper surface 1514 of the building structure for securement thereto. The inner cap portion 1536 is secured to the upper cleat portion 1522 by a spring clip 1540 secured to the upper cleat portion 1522 and having a free-floating locator flange 1557, similar to that discussed above.

In all of the embodiments exemplified in FIGS. 21 through 27, a cover locator 1350, 1450, 1550 is disposed between the inside surface of the cover cap 1330, 1430, 1550 and the cover cleat 1320, 1420, 1520. The cover locator 1350,1450, 1550 has upper and lower locator sides 1354, 1454, 1554, preferably with the upper locator side 1354, 1454, 1554 having an upper locator flange 1356, 1456, 1556 that is secured to the upper surface 1314, 1414, 1514 of the building structure. A slidable, free-floating locator flange 1357, 1457, 1557 is adjacent to the lower side edge of the lower locator side 1354, 1454, 1554. In the exemplary embodiments of FIGS. 21 through 27, the lower locator side 1354, 1454, 1554 and the free floating locator flange 1357, 1457, 1557 intersect transversely to form a free-floating locator side edge that is free to move or float relative to the cover cleat 1320, 1420, 1520. Because of this arrangement, the cover locator 1350, 1450, 1550 is yieldable, or resiliently compressible, in order to better facilitate the ease of installation of the cover cap 1330, 1430, 1530 while maintaining the necessary support and shape-maintenance function of the cover locator 1350, 1450, 1550 for the cover cap 1330, 1430, 1530.

Further, in the embodiments illustrated in FIGS. 21 through 27, the preferred free-floating side edge, formed by the transverse intersection of the lower locator side 1354, 1454, 1554 and the free-floating locator flange 1357, 1457, 1557, is preferably in a slidable, free-floating contact or engagement with the outer cleat portion 1324, 1424, 1524. The cover locator 1350, 1450, 1550 is symmetrical about a line 1351, 1451, 1551 normal to the outer cleat portion 1324, 1424, 1524 and the wall 1316, 1416, 1516 from which it protrudes. Although other relationships are also within the scope of the invention, the preferred cover locator 1350, 1450, 1550 shown in FIGS. 21 through 27 also has a generally triangular lateral cross-sectional shape such that the normal line 1351, 1451, 1551 extends though the apex 1352, 1452, 1552 between two equal sides of the generally triangular cross-sectional shape of the cover locator 1350, 1450, 1550 at least before and after the installation of the cover cap 1330, 1430, 1530. In other respects, however, the cover assembly embodiments of FIGS. 21 through 27 are generally similar in function to the embodiments of FIGS. 18 through 20. It should also be noted that the free-floating side edge of the cover locator 1350, 1450, 1550 can alternatively be in contact with, out of contact with, the cover cleat 1324, 1424, 1524 until installation of the cover cap 1330, 1430, 1530.

As mentioned above, in all embodiments the tab-type securements and the driven fastener or threaded fastener securements described herein are generally interchangeable with each other, or with various welding securements (e.g., TIG, MIG, or spot welding), as well as with other welding or fastening means known to those skilled in the art.

The foregoing discussion discloses and describes merely exemplary embodiments of the present invention for purposes of illustration only. The various illustrative alternate embodiments depicted and described herein demonstrate the flexibility of the applicability of the present invention to widely diverse installations. One skilled in the art will readily recognize from such discussion, and from the accompanying drawings and claims, that various changes, modifications, and variations can be made therein without departing from the spirit and scope of the invention as defined in the following claims.

What is claimed is:

1. A cover assembly for an edge portion of an upper surface of a building structure, the edge portion extending in a longitudinal direction along an outer surface of the building structure and having an edge portion upper surface and an edge portion outer face extending generally downwardly from an outer side of the edge portion upper surface, said cover assembly comprising:

a cover cleat for fixed securement to the building structure, said cleat having an upper cleat portion extending along the upper surface of the building structure, an outer cleat portion extending generally downwardly from an outer side of said upper cleat portion and along the outer surface of the building structure, and an inner cleat portion at an opposite inner side of said upper cleat portion;

a cover cap having an upper cap portion, an outer cap portion extending generally downwardly from a first side of said upper cap portion and an inner cap portion at an opposite side of said upper cap portion, said outer and inner cap portions having edges secured to said respective outer and inner cleat portions; and a cover locator secured to said cover cleat along at least a first side edge of said locator and being disposed between said cover cleat and said cover cap, said locator protruding from said cover cleat and engaging a first portion of an underside of said cover cap in order to space said first portion of said underside of said cover cap a predetermined generally fixed distance from said cover cleat, said locator also maintaining at least a portion of said cover cap in a predetermined cross-sectional shape, said locator further having a second side edge that is free-floating relative to said outer cleat portion, said cover locator being resiliently yieldable during installation of said cover cap onto said locator and said cover cleat.

2. A cover assembly according to claim 1, wherein said cover cap is formed in cap sections of a predetermined longitudinal length, said cap sections serially abuttingly engaging one another and extending along said cover cleat, said cover assembly further including a joint cover disposed between said underside of adjacent cover cap sections and said cover locator at said abutting engagement of said adjacent cover cap sections in order to maintain alignment of said adjacent cover cap sections at said abutting engagement.

3. A cover assembly according to claim 2, wherein said joint cover and said cover cap have substantially the same cross-sectional shape.

4. A cover assembly according to claim 2, wherein said joint cover also extends between said underside of said cover cap and said inner cleat portion.

5. A cover assembly according to claim 4, wherein said joint cover and said cover cap have substantially the same cross-sectional shape.

6. A cover assembly according to claim 1, wherein said cover locator protrudes from said outer cleat portion to engage said underside of said outer cover cap portion.

7. A cover assembly according to claim 1, wherein said cover locator has a first flange extending longitudinally along said first side edge, said first flange being secured to said cover cleat.

8. A cover assembly according to claim 1, wherein said cover locator has a second flange extending longitudinally along said second side edge, said second flange and an adjacent side portion of said cover locator transversely intersecting with one another to form said slidable free-floating second side edge.

9. A cover assembly according to claim 1, wherein the edge portion outer face and said outer cleat portion both extend generally vertically downwardly.

10. A cover assembly according to claim 1, wherein said inner cleat slopes generally in an outward and upward direction relative to said respective edge portion upper surface.

11. A cover assembly according to claim 1, wherein said inner cleat portion resiliently engages an inner side of said inner cap portion.

12. A cover assembly according to claim 1, wherein said edge portion upper surface and said upper cleat portion both extend generally horizontally.

13. A cover assembly according to claim 1, wherein said inner cleat and said upper cleat portions both extend generally horizontally adjacent to said edge portion upper surface.

14. A cover assembly according to claim 1, wherein said cover locator is symmetrical about a horizontal line normal to the outer cleat portion.

15. A cover assembly according to claim 14, wherein said cover locator has a generally triangular lateral cross-sectional shape, said normal horizontal line extending through an apex between two equal sides of said triangular cross-sectional shape both before and after said installation of said cover cap.

16. A cover assembly according to claim 1, wherein said cover cap outer and inner cap portions have generally hook-shaped edge portions thereon for snap-on engagement with respective outer and inner cleat portion edges.

17. A cover assembly according to claim 1, wherein said cover cap outer cap portion has a generally hook-shaped edge portion thereon for snap-on engagement with outer cleat portion edge and said cover cap inner cap portion is secured to said edge portion upper surface.

18. A cover assembly according to claim 1, wherein the edge portion is a building roof.

19. A cover assembly according to claim 1, wherein the edge portion protrudes upwardly from a building roof.

20. A cover assembly according to claim 16, wherein the edge portion is a gravel stop on a building roof.

21. A cover assembly according to claim 16, wherein the edge portion is a cant dam on a building roof.

22. A cover assembly according to claim 1, wherein the edge portion and said cover cleat are fixed to one another.

23. A cover assembly according to claim 1, further comprising a spring clip fixed relative to said cover cleat and disposed between said cover cleat and said cover cap, said spring clip having at least one resilient spring clip portion resiliently engaging a second portion of the underside of said cover cap.

24. A cover assembly according to claim 1, wherein said cover locator has a first flange extending longitudinally along said first side edge, said first flange being secured to said cover cleat, said second side edge being in a slidable free-floating engagement with said cleat, said cover locator being compressible to allow said slidable free-floating engagement during said installation of said cover cap.

25. A cover assembly according to claim 1, wherein said cover locator is symmetrical about a line normal to at least one surface of the edge portion and has a generally triangular lateral cross-sectional shape, said normal line extending through an apex between two equal sides of said triangular cross-sectional shape at least after said installation of said cover cap.

* * * * *